US011927061B2

(12) United States Patent
Keast et al.

(10) Patent No.: US 11,927,061 B2
(45) **Date of Patent: *Mar. 12, 2024**

(54) REEVING SYSTEM FOR SUPPORTING A LOAD

(71) Applicant: Larry G. Keast, Houston, TX (US)

(72) Inventors: Larry G. Keast, Houston, TX (US); Keith J. Orgeron, Spring, TX (US)

(73) Assignee: Larry G. Keast, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/124,910

(22) Filed: Mar. 22, 2023

(65) Prior Publication Data

US 2023/0220737 A1 Jul. 13, 2023

Related U.S. Application Data

(63) Continuation of application No. 17/576,315, filed on Jan. 14, 2022, now Pat. No. 11,634,952.

(60) Provisional application No. 63/137,486, filed on Jan. 14, 2021.

(51) Int. Cl.
*E21B 19/15* (2006.01)

(52) U.S. Cl.
CPC ..... *E21B 19/155* (2013.01)

(58) Field of Classification Search
CPC ..... E21B 19/155; E21B 19/14; E21B 19/20; E21B 19/15; E21B 19/16; E21B 19/02; E21B 19/087; B66F 1/025; B66F 11/00; B66F 9/18; B66F 1/08
See application file for complete search history.

(56) References Cited

U.S. PATENT DOCUMENTS

| | | | | |
|---|---|---|---|---|
| 4,739,868 | A | 4/1988 | Head | |
| 4,890,681 | A | 1/1990 | Skelly | |
| 6,877,942 | B2 | 4/2005 | Eastcott | |
| 7,163,367 | B2 | 1/2007 | Handley | |
| 8,387,720 | B1 | 3/2013 | Keast et al. | |
| 8,807,208 | B1 | 8/2014 | Keast | |
| 8,840,352 | B2 | 9/2014 | Taggart et al. | |
| 9,249,655 | B1 | 2/2016 | Keast et al. | |
| 9,388,647 | B2 | 7/2016 | Dahmes et al. | |
| 11,634,952 | B2 * | 4/2023 | Keast | E21B 19/087 414/22.57 |
| 2010/0163247 | A1 | 7/2010 | Wright et al. | |
| 2016/0060982 | A1 | 3/2016 | Layden | |
| 2017/0198534 | A1 | 7/2017 | Folk | |

* cited by examiner

*Primary Examiner* — Lynn E Schwenning
(74) *Attorney, Agent, or Firm* — Kearney, McWilliams & Davis PLLC; John M. DeBoer

(57) ABSTRACT

A powered unit with a reeving system for supporting a load associated with operation of the powered unit. The reeving system has a first cylinder with a first rod movingly disposed therein. There is a movable sheave spreader engaged with the first rod, and having a first spreader sheave, the movable sheave spreader also movably engaged with the powered unit.

19 Claims, 18 Drawing Sheets

REEVING SYSTEM FOR SUPPORTING A LOAD

BACKGROUND

Field of the Disclosure

This disclosure generally relates to machines, tools, systems, and the like used in the oil and gas industry for combining the functions of a pipe handler and a power swivel. More specifically, the disclosure relates to a single unit for moving individual tubulars and separately moving a power swivel and various other items or equipment to or from a rig floor. Other embodiments of the disclosure pertain to the use of a reeving system for supporting a load.

Background of the Disclosure

When drilling for oil or gas, a wellbore is typically drilled using a drill bit attached to the lower end of a "drill string." The process of drilling a well typically includes a series of drilling, tripping, casing and cementing, and repeating as necessary. The process of doing well servicing on a previously drilled, completed, and producing well uses many of the same operations although rotation is only required for operations such as milling out a packer and/or sometimes for drilling the well deeper. FIG. 1 shows a simplified view of a conventional drilling operation 100. A derrick 102 (or drilling rig) is configured to rotate a drill string 104 that has a drill bit 106 disposed at a lower end of the drill string 104, typically using a power swivel/top drive 110 and associated equipment. The power swivel/top drive 110 rotates the string 104 and the drill bit 106 to do drilling or milling work downhole in the wellbore 108

Near the derrick 102, a plurality of tubular members 103*a* are often stored on a pipe rack(s) 112. The pipe rack 112 is relatively near the ground, and substantially below the rig floor 115. Therefore, tubulars 103, 103*a* must be transported to the rig floor 115 joint by joint for use in drilling or servicing operations.

Pipe handling systems are utilized to transport the tubular 103 from the pipe rack 112 and present the tubular 103 to rig floor 115 for use by rig floor personnel. Such pipe handling systems are commonly available from rental companies, well servicing or drilling companies, and the like. These systems are typically known as pipe handlers or hydraulic catwalks.

Before such handling equipment, handling of tubulars 103*a* has long been a problem when moving a tubular from a horizontal position on the catwalk 113, up an inclined ramp or V-door 114, to the rig floor in the derrick 102 where rig floor personnel can latch on with an elevator and raise the pipe to a vertical position. Additional men along with crude and dangerous handling procedures such as cables and winching have been required to move the tubular 103 to the angular position at the rig floor for use by rig floor personnel. Accidents and injuries have been commonplace.

Currently, many variations of pipe handling systems exist which are much safer. However, no system exists which combines the functions of a power swivel with a pipe handler. Currently, separate pipe handling and power swivel systems must be bought or rented, requiring two hauls to the rig site and taking up two equipment spaces at the rig site. The use of separate pipe handler and power swivel means twice as many service companies, twice as much equipment, twice as many people, twice as much space used, and inefficient use of rig time.

No mobile single system currently exists which may allow for coordinating the movement of a tubular to an angular presentation at a rig floor, threadably engaging the tubular at an adjustable angle with a power swivel, and for lifting the tubular to a vertical position, then rotating into the preceding joint of pipe.

Similarly, if company policy does not allow power swivel rotation into the pipe connection, this machine may be equipped with a pipe push and rotate function, which allows threadable engagement with the power swivel without power swivel rotation.

Additionally, an unsafe condition exists for moving a power swivel to a rig floor from its transport trailer. This work has been done typically by using two men and two winch lines with the power swivel in between, an obviously unsafe and dangerous condition. This combination machine easily and safely moves the power swivel from its transport position to the rig floor using the pipe handler controls and without men using winch lines.

The to reach greater heights, means more load support. While possible if a steep delivery angle is utilized, this adds risk to an operator, as the coupling of the power swivel to a more or less vertical delivery of a tubular requires the operator to swing the power swivel out from the rig floor.

A need exists, therefore, for a combination tubular handling system and a power swivel to provide a rig site space saving solution, a rapid and safe pipe handling solution, a rapid and safe solution to transport the power swivel to and from the rig floor, a rapid and safe solution to transport various unrelated items and equipment to and from the rig floor, a power swivel tilt function allowing tilting the power swivel to a preset angle matching the pipe angle for rapid and safe spinup of the threaded connection against a soft low torque backup, and an alternate pipe rotation solution if power swivel rotation is not allowed.

Additionally, a need exists for safely transporting unrelated items and equipment from the ground to the rig floor. The trough of this unit may be arranged with hooks, shackles, chain, basket, mounts, etc. to allow the safe temporary attachment of such items for transport to or from the rig floor. Doing so can eliminate operators carrying items up a set of stairs and eliminates operators using winches and cables. This usage also moves such items to an open space on the rig floor without handrails in the way.

A further need exists for a load support system that allows delivery of an item (i.e., pipe, equipment, power swivel, etc.) to the rig floor at higher heights and/or with desired delivery angle.

The ability to increase efficiency and save operational time and expense while increasing safety leads to considerable competition in the marketplace. Achieving any ability to save time, or ultimately cost, while increasing safety leads to an immediate competitive advantage. Thus, there is a need in the art for a pipe handling system that saves time and increases safety.

SUMMARY

Embodiments of the present disclosure pertain to a combination tubular and power swivel handler, and may sometimes be referred to simply as a 'combination unit' or 'unit'. The equipment of the combination unit may be mounted on a trailer or other form of support frame, skid, chassis, etc.

Embodiments herein pertain to a load support system. The load support system may be a reeving system coupled with a frame and other components of a skid unit, such as a tubular handler. The reeving system may be used with units of the present disclosure and related embodiments.

Embodiments of the disclosure pertain to a combination tubular handler and power swivel unit coupled with a trailer; and a power swivel movingly disposed on the trailer. The tubular handler may have one or more of: a trough assembly; a raising leg movingly coupled with the trough assembly; and a following leg pivotably coupled with an end of the trough assembly.

The unit may have a transport mechanism configured to facilitate transfer of a tubular to the trough assembly. The transport mechanism may include one or more movable arms extending from the unit, to pick up or deliver a tubular from a pipe rack. The transport mechanism may have a pipe kicker(s) in association therewith which may be disposed in the trough assembly.

Embodiments herein pertain to a reeving system for supporting a load associated with operation of a powered unit. The powered unit may have a raising leg coupled with a support frame.

The reeving system may include a first cylinder having a first cylinder end configured to couple with the raising leg and a second cylinder end having a first rod movingly disposed therein. The reeving system may include a movable sheave spreader engaged with the first rod, and having a first spreader sheave. The movable sheave spreader may be configured to movably engage with the raising leg.

The reeving system may include a first set of sheave mounts configured to couple (e.g., fixedly) with the raising leg. Any of the mounts may have a respective mount sheave. The reeving system may include a first cable having a first cable end configured to couple with an anchor point disposed on the raising leg. There may be a second end configured to couple with a device associated with the load. In aspects, the cable may be engaged with the first spreader sheave and one or more respective sheaves of the first set of sheave mounts.

The device may be configured to slidingly move within a guide rail of the raising leg. The device may be configured to couple with a spindle that provides a point of rotation between the raising leg and the device.

The reeving system may include a second cylinder having a first respective cylinder end coupled with the raising leg and a second respective end having a second rod movingly disposed therein. The reeving system may include a second set of sheave mounts fixedly coupled with the raising leg. Any of the mounts may have or be associated with a respective second sheave pulley.

In aspects, the movable sheave spreader may be engaged with the second rod. The spreader may have a second spreader sheave. There may be a second cable having a respective first cable end configured to couple with another anchor point on the raising leg. The second cable may have a respective second end configured to couple with another device engaged (e.g., slidingly) with the raising leg. The second cable may be engaged with the second spreader sheave and/or any respective sheave of the second set of sheave mounts.

The spreader may have one or more of a horizontal member with a first frame end and a second frame end configured to movingly engage with the raising leg and/or a first sheave housing comprising the first spreader sheave coupled therewith, and a first pulley housing stem coupled with the first rod. In other aspects, the sheave spreader may have a second sheave housing comprising the second spreader sheave coupled therewith, and/or a respective second sheave housing stem coupled with the second rod. The movable sheave spreader may be configured to move from a first position to a second position upon actuation of the first cylinder and the second cylinder. The spreader may return to the first position upon deactuation of the first cylinder and the second cylinder. Actuation may entail, for example, pressurizing the respective cylinders to extend the respective rod therefrom. Deactuation may entail relieving pressure from the respective cylinders to facilitate retraction of the respective rods.

The reeving system may be configured to pull a device until the device engages a stopper disposed within the raising leg. For example, the second position may correspond with the device engaged with the stopper. The distance traversed by the movable sheave spreader from the first position to the second position may be approximately half the distance traversed by the device.

Yet other embodiments of the disclosure pertain to a powered unit, such as combination tubular handler and delivery unit having one or more of the following: a support frame; a tubular handler coupled with the support frame; a raising leg movingly coupled with the tubular handler via a first guide rail having the first slider engaged therewith. The raising leg may have one or more anchor points.

The powered unit may have a reeving system. The reeving system may include, for example, a first cylinder having a first cylinder end coupled with the raising leg and a second cylinder end having a first rod movingly disposed therein. There may be a movable sheave spreader engaged with the first rod, and having a first spreader sheave. The movable sheave spreader may have a sheave slider engaged with the first guide rail.

The powered unit may have a first set of sheave mounts coupled with the raising leg. Any mount may have a respective mount sheave, which may be movingly engaged therewith. There may be a first cable having a first cable end coupled with the anchor point, and a second end coupled with the first slider. The first cable may be engaged with the first spreader sheave and each respective sheave of the first set of sheave mounts.

The tubular handler may include a trough assembly configured with any of the following: a main trough having a first end configured for a secondary trough to extend therefrom; the main trough having an underside configured with a trough housing; a first slider extending from the trough housing; the first slider engaged with a spindle disposed within the trough housing.

The powered unit may have a transport mechanism configured to facilitate transfer of an at least one tubular to the trough assembly. The trough housing may have a second side configured with a second slider extending therefrom. The raising leg may be configured with a second guide rail. The second slider may movingly engage with the second guide rail.

The powered unit may have the reeving system that includes a second cylinder having a first respective cylinder end coupled with the raising leg and a second respective cylinder end having a second rod movingly disposed therein. There may be a second set of sheave mounts coupled with the raising leg. Any mount may have a respective second set mount sheave.

The raising leg may have a second anchor point. The movable sheave spreader may be engaged with the second rod. There may be a second spreader sheave. There may be a second cable having a respective first cable end coupled with the second anchor point, and a respective second end coupled with the second slider. The second cable may be engaged with the second spreader sheave, and any respective sheave of the second set of sheave mounts.

The movable sheave spreader may include a horizontal member with a first frame end and a second frame end movingly engaged with the raising leg. There may be a first sheave housing that includes the first spreader sheave coupled therewith. There may be a first sheave housing stem coupled with the first rod.

The movable sheave spreader may include a second sheave housing having the second spreader sheave coupled therewith. There may be a respective second sheave housing stem coupled with the second rod.

The movable sheave spreader may be configured to move from a first position to a second position, such as upon actuation of the first cylinder and/or the second cylinder. The movable sheave spreader may be configured to return to the first position upon deactuation of the first cylinder and/or the second cylinder. The second position may correspond with the first slider and the second slider engaged with a respective stopper disposed in either of the first and/or second guide rails. In aspects, the distance traversed by the movable sheave spreader from the first position to the second position may be about half the distance traversed by the first slider and/or the second slider.

The powered unit may further include a following leg pivotably coupled with the raising leg. The reeving system may be configured to pull the first and/or second sliders until either or both the sliders engage with the respective stoppers. In aspects, unless and until the second position is reached, the following leg may be hindered or unable to move.

The first guide rail may be configured with a ratchet structure that comprises an alternating crest and trough structure. A locking dog may be configured to navigate or move through the ratchet structure in a first direction over each adjacent crest/trough, but is locked from moving in the opposite direction.

The powered unit may include either or both of: a hose reel comprising a plurality of hoses; a pump disposed on the support frame.

Automation of repetitive tasks with this handler may provide rapid and safe presentation of tubulars to the rig floor which minimizes the need for personnel to have "hands on" equipment or tubulars, thus increasing the safety of operations. Further, the flexibility of being able to use either the tubular handler or the power swivel, or both together, may improve equipment utilization rates, improve safety, and save time, and therefore reduce overall cost, and increase profitability for users (such as rental or service companies).

These and other embodiments, features and advantages will be apparent in the following detailed description and drawings.

BRIEF DESCRIPTION OF THE DRAWINGS

A full understanding of embodiments disclosed herein is obtained from the detailed description of the disclosure presented herein below, and the accompanying drawings, which are given by way of illustration only and are not intended to be limitative of the present embodiments, and wherein.

DETAILED DESCRIPTION

Figure 1:
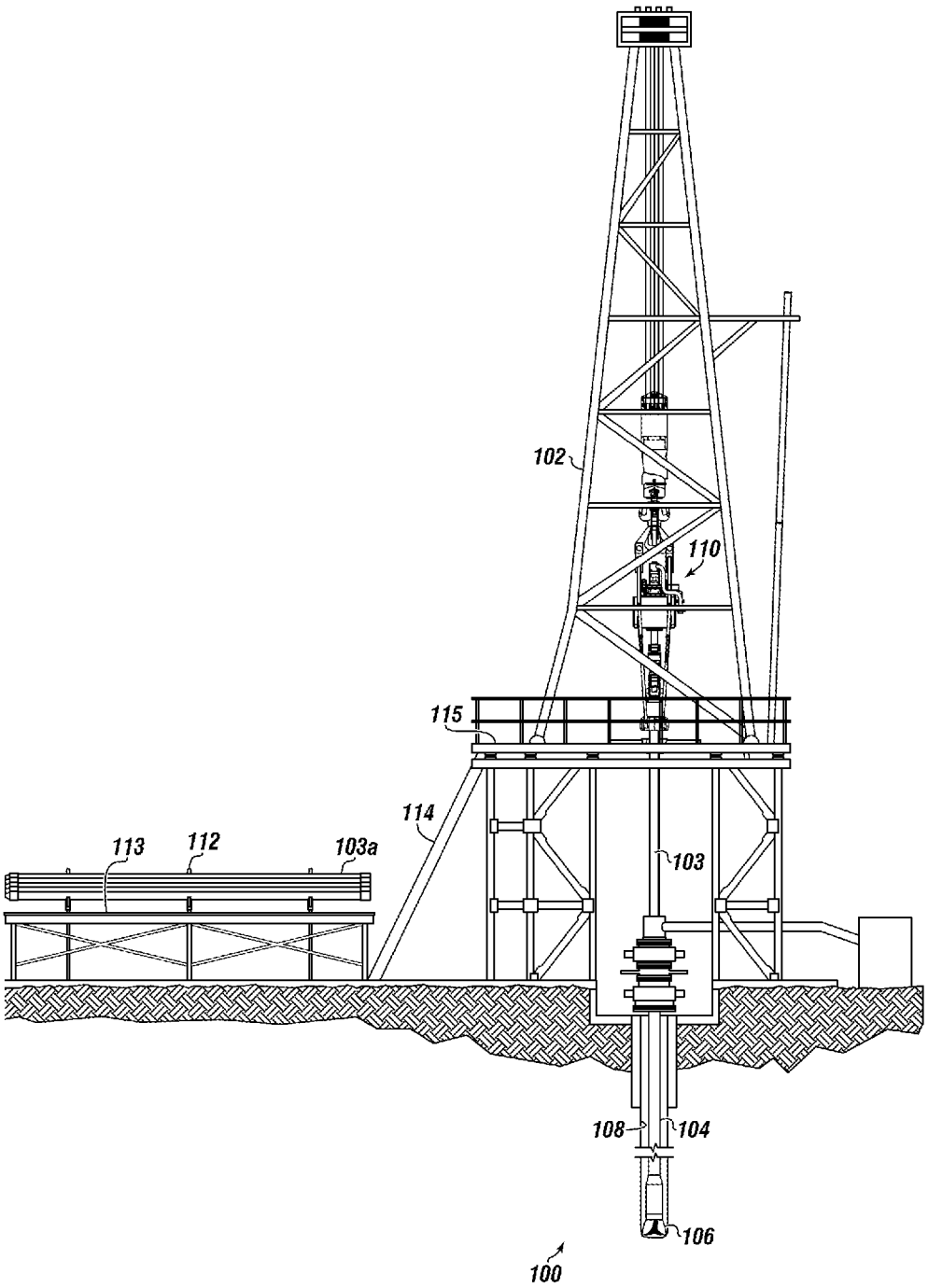
FIG. 1 (Prior Art)
FIG. 1 is a side view of a process diagram of a conventional drilling operation for an oil and gas production system.

Regardless of whether presently claimed herein or in another application related to or from this application, herein disclosed are novel apparatuses, units, systems, and methods that pertain to improved handling of tubulars, details of which are described herein.

Embodiments of the present disclosure are described in detail with reference to the accompanying Figures. In the following discussion and in the claims, the terms "including" and "comprising" are used in an open-ended fashion, such as to mean, for example, "including, but not limited to . . . ". While the disclosure may be described with reference to relevant apparatuses, systems, and methods, it should be understood that the disclosure is not limited to the specific embodiments shown or described. Rather, one skilled in the art will appreciate that a variety of configurations may be implemented in accordance with embodiments herein.

Although not necessary, like elements in the various figures may be denoted by like reference numerals for consistency and ease of understanding. Numerous specific details are set forth in order to provide a more thorough understanding of the disclosure; however, it will be apparent to one of ordinary skill in the art that the embodiments disclosed herein may be practiced without these specific details. In other instances, well-known features have not been described in detail to avoid unnecessarily complicating the description. Directional terms, such as "above," "below," "upper," "lower," "front," "back," etc., are used for convenience and to refer to general direction and/or orientation, and are only intended for illustrative purposes only, and not to limit the disclosure.

Connection(s), couplings, or other forms of contact between parts, components, and so forth may include conventional items, such as lubricant, additional sealing materials, such as a gasket between flanges, PTFE between threads, and the like. The make and manufacture of any particular component, subcomponent, etc., may be as would be apparent to one of skill in the art, such as molding, forming, press extrusion, machining, or additive manufacturing. Embodiments of the disclosure provide for one or more components to be new, used, and/or retrofitted to existing machines and systems.

Various equipment may be in fluid communication directly or indirectly with other equipment. Fluid communication may occur via one or more transfer lines and respective connectors, couplings, valving, piping, and so forth. Fluid movers, such as pumps, may be utilized as would be apparent to one of skill in the art.

Numerical ranges in this disclosure may be approximate, and thus may include values outside of the range unless otherwise indicated. Numerical ranges include all values from and including the expressed lower and the upper values, in increments of smaller units. As an example, if a compositional, physical or other property, such as, for example, molecular weight, viscosity, melt index, etc., is from 100 to 1,000. it is intended that all individual values, such as 100, 101, 102, etc., and sub ranges, such as 100 to 144, 155 to 170, 197 to 200, etc., are expressly enumerated. It is intended that decimals or fractions thereof be included. For ranges containing values which are less than one or containing fractional numbers greater than one (e.g., 1.1, 1.5, etc.), smaller units may be considered to be 0.0001, 0.001, 0.01, 0.1, etc. as appropriate. These are only examples of what is specifically intended, and all possible combinations of numerical values between the lowest value and the highest value enumerated, are to be considered to be expressly stated in this disclosure. Numerical ranges are provided within this disclosure for, among other things, the relative amount of reactants, surfactants, catalysts, etc. by itself or in a mixture or mass, and various temperature and other process parameters.

Terms

The term "connected" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth. Any use of any form of the terms "connect", "engage", "couple", "attach", "mount", etc. or any other term describing an interaction between elements is not meant to limit the interaction to direct interaction between the elements and may also include indirect interaction between the elements described.

The term "fluid" as used herein may refer to a liquid, gas, slurry, single phase, multi-phase, pure, impure, etc. and is not limited to any particular type of fluid such as hydrocarbons.

The term "fluid connection", "fluid communication," "fluidly communicable," and the like, as used herein may refer to two or more components, systems, etc. being coupled whereby fluid from one may flow or otherwise be transferrable to the other. The coupling may be direct, indirect, selective, alternative, and so forth. For example, valves, flow meters, pumps, mixing tanks, holding tanks, tubulars, separation systems, and the like may be disposed between two or more components that are in fluid communication.

The term "pipe", "conduit", "line", "tubular", or the like as used herein may refer to any fluid transmission means, and may (but need not) be tubular in nature.

The term "composition" or "composition of matter" as used herein may refer to one or more ingredients, components, constituents, etc. that make up a material (or material of construction). Composition may refer to a flow stream of one or more chemical components.

The term "skid" as used herein may refer to one or more pieces of equipment operable together for a particular purpose. For example, a 'catwalk-power swivel skid' may refer to one or more pieces of equipment operable together to provide or facilitate presenting a tubular to a derrick. A skid may be mobile, portable, or fixed. Although 'skid' may refer to a modular arrangement of equipment, as used herein may be mentioned merely for a matter of brevity and simple reference, with no limitation meant. Thus, skid may be comparable or analogous to zone, system, subsystem, and so forth.

The term "skid mounted" as used herein may refer to one or more pieces operable together for a particular purpose that may be associated with a frame- or skid-type structure. Such a structure may be portable or fixed.

The term "engine" as used herein may refer to a machine with moving parts that converts power into motion, such as rotary motion. The engine may be powered by a source, such as internal combustion.

The term "motor" as used herein may be analogous to engine. The motor may be powered by a source, such as electricity, pneumatic, or hydraulic.

The term "pump" as used herein may refer to a mechanical device suitable to use an action such as suction or pressure to raise or move liquids, compress gases, and so forth. 'Pump' can further refer to or include all necessary subcomponents operable together, such as impeller (or vanes, etc.), housing, drive shaft, bearings, etc. Although not always the case, 'pump' may further include reference to a driver, such as an engine and drive shaft. Types of pumps include gas powered, hydraulic, pneumatic, and electrical.

The term "utility fluid" as used herein may refer to a fluid used in connection with the operation of a heat generating device, such as a lubricant or water. The utility fluid may be for heating, cooling, lubricating, or other type of utility.

'Utility fluid' may also be referred to and interchangeable with 'service fluid' or comparable.

The term "mounted" as used herein may refer to a connection between a respective component (or subcomponent) and another component (or another subcomponent), which may be fixed, movable, direct, indirect, and analogous to engaged, coupled, disposed, etc., and may be by screw, nut/bolt, weld, and so forth.

The term "power swivel" as used herein may refer to a type of equipment used on a service rig or drilling rig, mainly to facilitate rotational operations. A power swivel may be powered, such as hydraulically or electrically, for handling or rotating tubulars, and may also act as a channel for drilling fluid. It also supports the weight of the drill string of pipe safely over men's heads. as used herein may refer to any driver machine or device suitable and known to one of ordinary skill in the art to impart work, typically in the form of suspending and rotating pipe. A power swivel or a top drive is an example of such a driver. A power swivel known to one of skill as being an alternative to and different from a rotary table.

The term "tubular handler" as used herein may refer to a mechanism, assembly, system, combination of equipment, and so forth for handling a pipe. For example, a tubular handler may have an elevator with an inclined ramp, and a chain drive skate mechanism designed to raise or lower a tubular.

The term "handling", "handle", "handler", and the like, as used herein may refer to use of a machine (or a unit having a combination of machines, components, parts, etc.) to handle, move, deliver, present, transport, convey, etc. an object. For example, the combination unit of the present disclosure may handle a tubular, which may encompass the loading of the tubular into the unit, and then delivery of the tubular to a destination (such as a derrick for use in a workstring). The opposite may also be included. For example, the tubular may be removed from the workstring and loaded onto the unit from a rig floor, lowered to ground level, and delivered back to a tubular source.

The term "transfer mechanism" as used herein may refer to a mechanism for moving an object from a first position, such as a source, to a second position, such as within the combination unit.

The term "sheave" as used herein may refer to a pully or wheel (often with a groove) for holding a belt, rope, cable, wire rope, etc. The sheave may rotate on an axle or bearing inside a frame associated with a mount device or assembly, which allows whatever is wrapped around it to move freely, minimizing friction and wear. The words sheave and pulley may be used interchangeably.

The term "reeving" or "reeving" system as used herein may refer to use a belt, rope, cable, wire rope, etc. in connection with a sheave(s).

The term "cable" as used herein may generally refer to any type of rope, wire, string, cable, or other type of tension member and the like, which may be braided, twisted, unitary (single-strand), and of any desired material, including metal, composites, fibers, and so forth, and combinations thereof. The cable may or may not be sheathed. Any material suitable for traversing a sheave or pully may be contemplated as a 'cable' in accordance with embodiments herein.

Figure 2A:
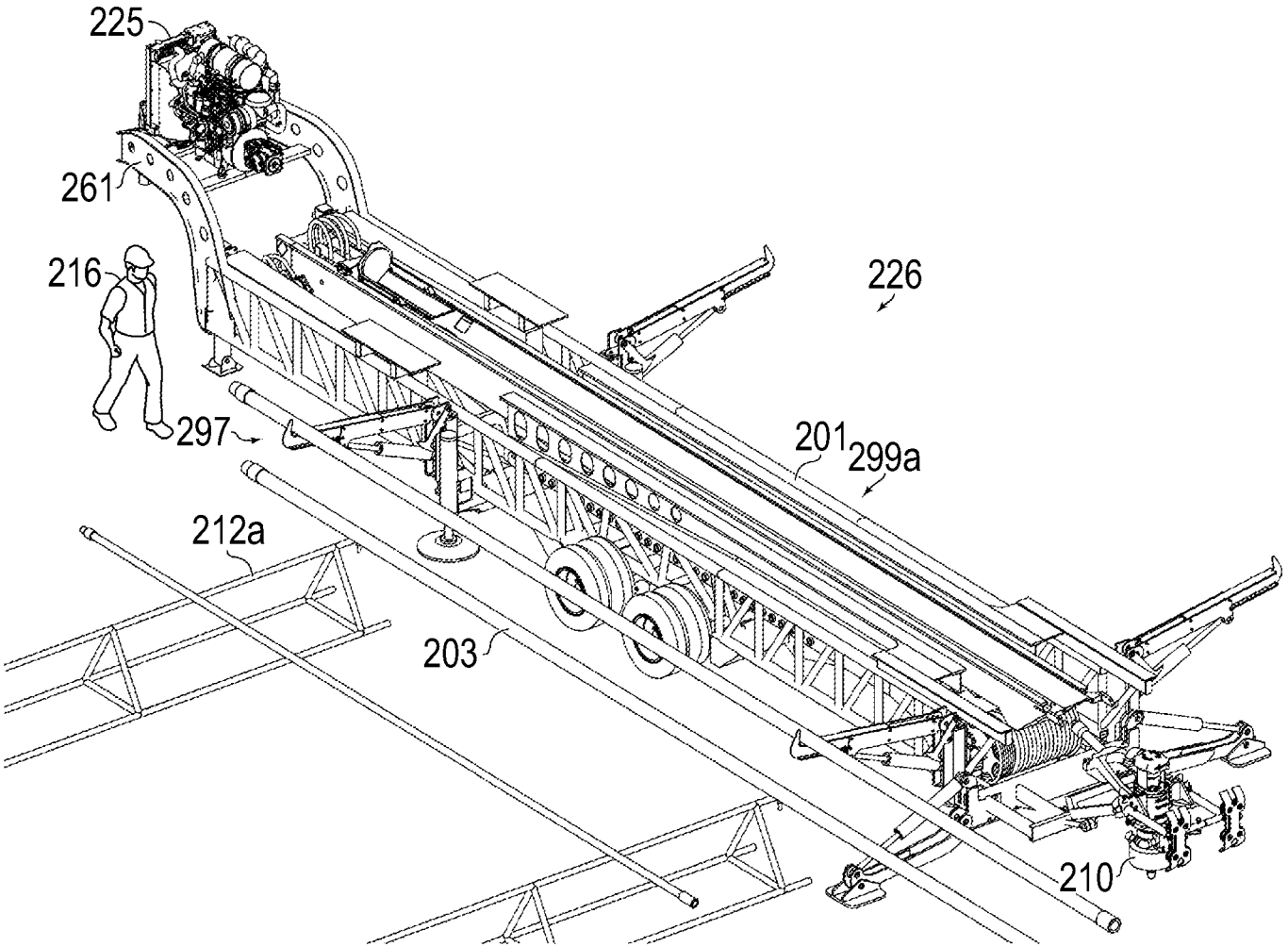
FIG. 2A shows an isometric front view of a working operation system using having a combination handling unit in a first position according to embodiments of the disclosure.

Referring now to FIGS. 2A-2E together, an isometric front view of a combination tubular and power swivel handling unit in a first position, an isometric front view of the combination unit of FIG. 2A in an intermediate position, an isometric front view of the combination unit of FIG. 2A having another intermediate position with an extended telescoping trough, an isometric front side view of the combination handling and transport unit of FIG. 2A in a delivery position where a tubular and a power swivel are presented to a rig floor, and an isometric front view of a power swivel of a drill rig coupled with a tubular delivered to the drill rig from a combination unit, illustrative of embodiments disclosed herein, are shown.

FIGS. 2A-2E show a drilling operation or system 200 having the combination tubular and power swivel handling unit 201. While referred to as 'drilling', the working operation or system 200 is not meant to be limited, as there are a number of instances and operations where the unit 201 may be used.

The combination unit 201 may be operated or otherwise used in a manner to provide, control, facilitate, etc. handling and transport of one or more components. In embodiments, the unit 201 may provide delivery of either a tubular 203, a power swivel 210, both, or other equipment to a rig or derrick 202. While it need not be exactly the same, the unit 201 may be assembled, run, and operated as described herein and in other embodiments, and as otherwise understood to one of skill in the art.

Components of the unit 201 may be arranged by, disposed on, or otherwise coupled with a trailer or support frame 213, and as otherwise understood to one of skill in the art. Thus, the unit 201 may be comparable or identical in aspects, function, operation, components, etc. as that of other unit embodiments disclosed herein. Similarities may not be discussed for the sake of brevity.

Associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components of the unit 201 for operation thereof. For example, a pump (with engine) 225 may be in fluid communication with one or more sources, such as a fluid tank, with the unit 201 (or its components) being in fluid communication with a discharge of the pump (such as via a manifold, piping, tubing, etc.). All components of the unit 201 requiring power or automation may be provided with wiring, tubing, piping, etc. in order to be operable therefore.

The unit 201 may be used with and part of the drilling system 200. As such, the system 200 may include the derrick 202 configured with suitable components to rotate a drill string 204. The drill string 204 may be rotated with the driver 210, typically a top drive or power swivel type mechanism (with associated elevator, drive frame, drawworks, etc.).

The unit 201 may be positioned proximate the derrick 202, whereby the unit 201 may be operated in manner to deliver one or more tubulars 203*a* and other equipment (such as driver 210) to and from a rig floor or working platform 215. The plurality of tubulars 203*a* may be transferred to and from a tubular source 212 via the unit 201 (typically one at a time). The tubular source 212 may include a pipe rack 212*a* having the plurality of tubulars 203*a* thereon. The unit 201 may have a transfer mechanism 297 to accommodate the transfer of the tubular 203 to and from the unit 201.

To any extent embodiments herein are described for the transfer of tubulars and equipment to the derrick 202, one of skill would appreciate that as a job or operation is finished or otherwise at a stopping point, the tubulars 203*a* may be removed (e.g., from the wellbore) in a similar albeit opposite manner, and thus the unit 201 operable to transfer tubulars 203*a* back to the source 212 and the power swivel 210 back to a support rack 251. Accordingly, the unit 501 may be configured with a mechanism or kicker (not shown here) to initiate transfer of tubulars 503*a* therefrom.

The support rack 251 may be movingly coupled with the support frame 213, and also operably engaged with a power source (such as a hydraulically movable piston/rod). Thus, the support rack 251 may be moved from a first or lowered position to a second or raised position. In embodiments, the first position may have an angle of rotation of 45 degrees to 120 degrees from the second position.

The transfer mechanism 297 may include a plurality of tubular handling arms 230 *a,b*. The tubular handling arms 230 *a,b* may be movingly coupled with the support frame 213, and also operably engaged with a power source (such as a hydraulically movable piston/rod). The handling arms 230 *a,b* may be positional to have a (slight) grade one way or another to allow the tubular(s) 203 to roll toward or away from a trough assembly 598, as may be applicable.

The trough assembly 298 may include a soft low torque pipe grabber to hold pipe against spinup torque of a power swivel if so used.

The unit 201 may be configured with one or more movable outriggers, extensions, legs etc. 219 coupled with the support 213, which may help secure or hold the unit 201 in a substantially immovable fashion.

The combination unit 201 may have the power swivel 210 movingly disposed thereon. That is, the power swivel 210 may be positioned within the power swivel support or rack 251. One or more components operatively associated (and connected, directly or indirectly) with the power swivel 210 may include any of a hose reel 227, a fluid tank(s) (not shown here), and a pump and engine 225. There may be one or more hoses 256 coupled between the power swivel 210 and the hose reel 227. The hose reel 527 may be configured with an amount of tension to aid or facilitate rolling up and unrolling of the hoses 256. Any or all of the hoses 256 may be of sufficient length to accommodate moving the power swivel 210 to a height h.

Figure 3A:
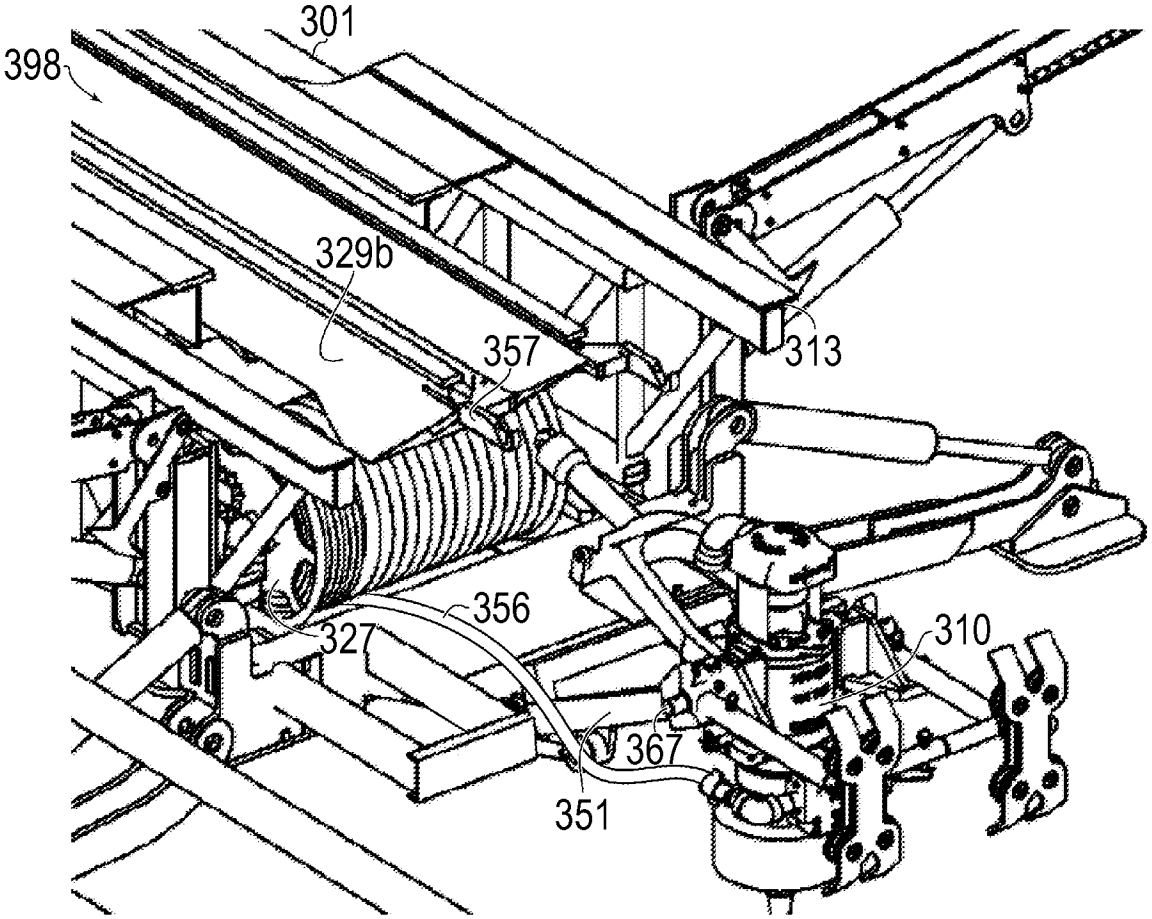
FIG. 3A shows a close-up isometric view of a power swivel disposed on a support rack of a combination handling unit according to embodiments of the disclosure.
Figure 3B:
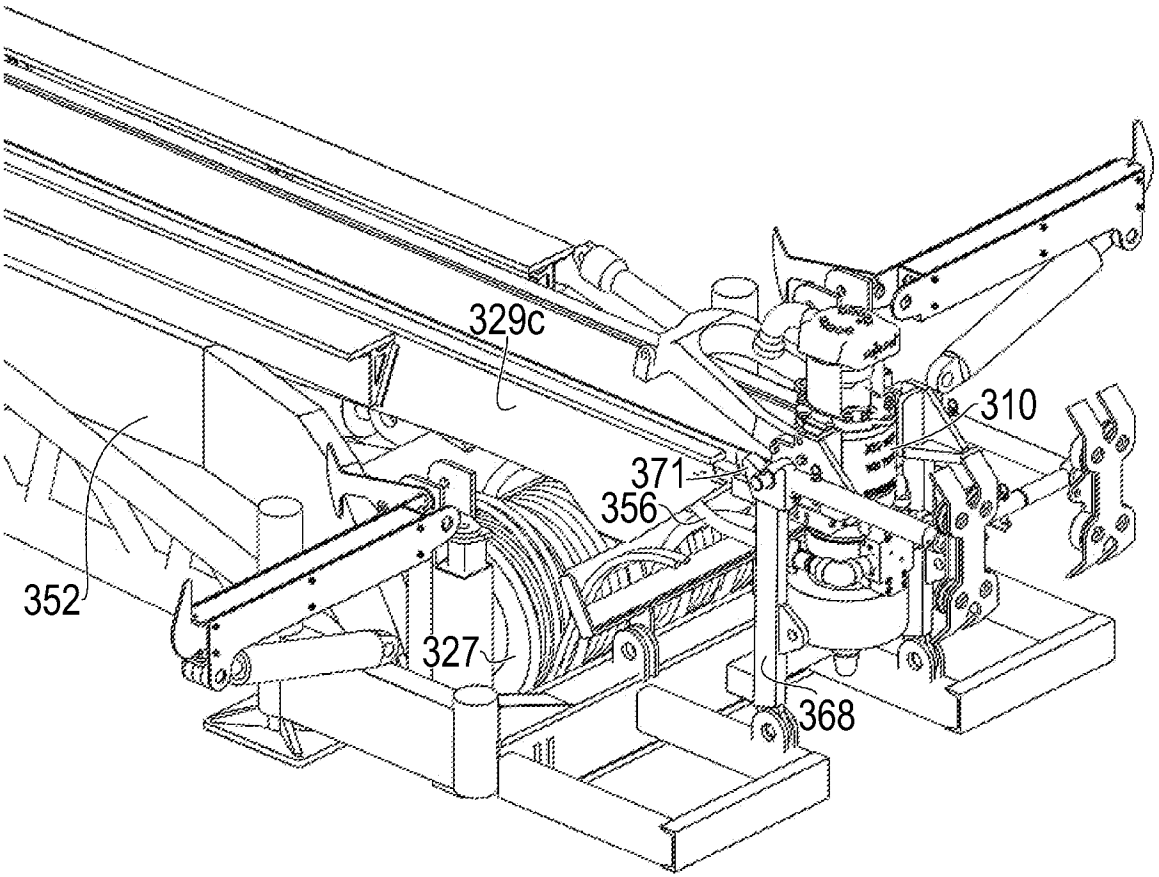
FIG. 3B shows close-up isometric view of the support rack moved to a raised position according to embodiments of the disclosure.
Figure 3C:
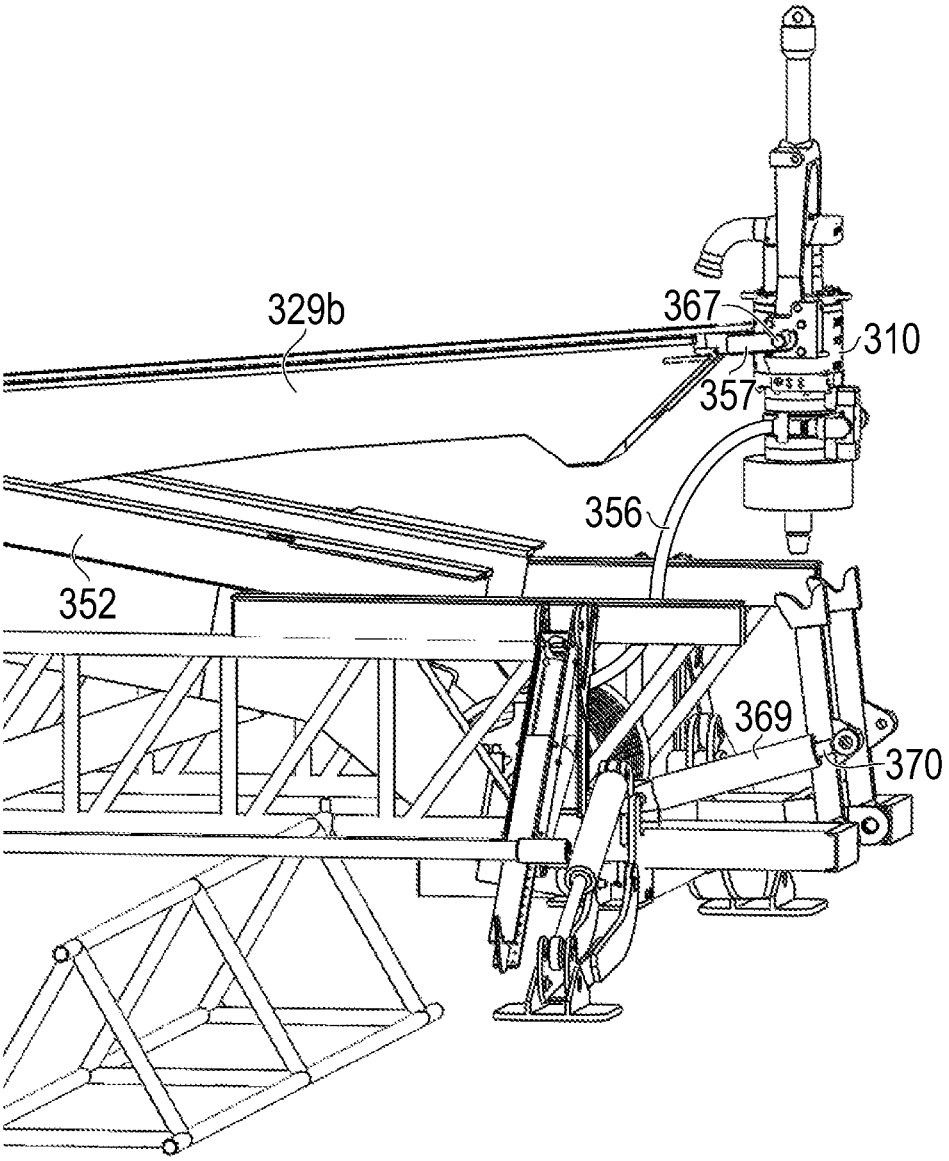
FIG. 3C shows a close-up side view of the power swivel lifted off the support rack according to embodiments of the disclosure.

Referring briefly to FIGS. 3A, 3B, and 3C together, a close-up isometric view of a power swivel disposed on a support rack of a combination unit, a close-up isometric view of the support rack moved to a raised position, and a close-up side view of the power swivel lifted off the support rack, illustrative of embodiments disclosed herein, are shown. [MOO] FIGS. 3A-3C together show a combination tubular and power swivel handler unit 201 may have a support frame 213 with one or more components coupled therewith, including movingly. For example, the combination unit 201 may have a trough assembly 298 (associated with a tubular handler) movingly coupled with the support frame 213. The combination unit 201 may also have a power swivel support rack 251 movingly coupled with the support frame 213. The power swivel support rack 251 may be movable from a first or lowered position (FIG. 3A) to a second or raised position (FIG. 3B).

There may be a hose reel 227 disposed on the unit 201. The hose reel may be disposed underneath an end 229*b* of the trough assembly 298. The hose reel 227 may have a set of hoses, such as one or more hoses 256. Any of the hoses 256 may be also coupled with the power swivel 210, such that the power swivel 210 may be in fluid communication with the hose reel 227, as well as a fluid source. The hose reel 227 may be configured for the hose 256 to readily unroll therefrom as the power swivel 210 is raised (and vice versa).

The support rack 251 may include one or more movable support rack arms 268. As shown here, there may be two support rack arms 268, each arm 268 being coupled with a respective powered (such as hydraulic) support rack piston/rod assembly 269. A rod 270 of the assembly 269 may be extendable/retractable therefrom corresponding to movement of the arm 268.

While not limited to any particular way of resting on the support rack 251, the power swivel 210 may have one or more support posts 267 extending therefrom. The support posts 267 may be configured to reside within a post receptacle 271 on the end of the support rack arm 268.

As the trough assembly 298 is raised by a raising leg 252, driver lifting hooks 257 may engage the support posts 267, and thus raise the power swivel from the support rack 251. The power swivel 210 may then be delivered to the derrick (202, FIG. 5E), including with hoses 256 coupled therewith. The unit 201 may accomplish in reverse the delivery of the power swivel 210 from the derrick to the support rack 251 (including with hoses 256 able to roll back up around hose reel 227).

Returning again to FIGS. 2A-2E, the unit 201 may include, or otherwise be in operable association with, an operator station 222. As the unit 201 may combine functionality, one of skill would appreciate that all operations associated with operating the tubular handler 226 (including operation of the trough assembly 298) and transfer mechanism 297, as well as operation of the power swivel 210 (including while on the derrick 202), may be accomplished by personnel 216 via the operator station 222, without need for other operator stations. The station 222 may be detachably secured to the support 213. Alternatively, there may be a separate remote control panel placed on the rig floor for the rig operator's control of power swivel 210.

The tubular handler 226 and transfer mechanism 297 may be movingly secured to or otherwise coupled with the support frame 213. The transfer mechanism 297 may include an indexing mechanism (not viewable here) to index one tubular 203 (of a plurality of tubulars 503*a*) at a time into the trough assembly 298.

The trough assembly 298 may include a main trough 229. The trough assembly 298 may have a portion thereof (such as an end 229*b*) configured for lifting the power swivel 210 off the rack 251.

The trough assembly 298 may have a carrier trough 229*a* movingly engaged with the main trough 229. For example, the carrier trough 229*a* may be telescopingly movable with respect to the main trough 229, thereby providing additional length to which the trough assembly 298 may reach. In embodiments, the carrier trough 229*a* may extend between and including 0 feet and 50 feet out from the main trough 229.

Movement of the carrier trough 229*a* may be via a sprocket and chain mechanism, rollers, and so forth, which may be powered in a manner known to one of skill in the art. The carrier trough 229*a* may have one or more lifting hooks 257 configured to lift the power swivel 210 from the rack 251 (and vice versa). The trough 229*a* may have soft low torque backup for the power swivel 210 (including while in a tilted position) into box connection of the tubular(s) 203.

Alternatively, a grabber function may be added to a power swivel to safely react the spinup torque applied by the power swivel.

Although not limited to any particular shape other than what might otherwise be suitable to hold the tubular 203, either of the troughs 229, 229*a* may be a general v-shaped structure (in lateral cross-section), which may be useful to center the tubular 203. The trough assembly 298 may have a pusher or skate 232 operatively and movingly associated therewith. As such, the skate 232 may be operable to push the tubular 203 (or a portion of either troughs 229, 229*a*) in order to present the tubular 203 to the rig floor 215 (or the proximate area of the system 200 to which the string 204 may be made up). As such, the skate 232 may be movable via a sprocket and chain mechanism, rollers, and so forth, which may be powered in a manner known to one of skill in the art.

Spinup function may be used for powered spinup of the tubular 203 onto the pin (or stem) of the power swivel or without rotating serve as a backup against the spinup torque supplied by the power swivel.

The skate 232 may be part of an assembly configured to include a spin-up function. Accordingly there may be a device hinged atop a skate frame arranged with one or more jaw protrusions attached to a body allowing vertical motion within the "vertical center plane" of the trough such that when a connected actuator urges the body down upon a tubular so delivered to the trough center plane by a pipe handling system, said jaw protrusions on either side of said tubular, arranged to fit or hydraulically adjustable to fit the OD of various sized tubulars, will clamp on said tubular to provide a "backup" or reactive/resisting torque when said tubular is rotated by a powered rotating device such as a power swivel or hydraulic pipe wrench when said powered rotary device is used to apply a low spinup torque to a threaded connection of a tubular laying in a trough.

The tubular handler 226 may be configured with a mechanism or other suitable configuration to lift the trough assembly 298 (including an end of the trough 229*b*) to present or bring the tubular 203 to the drilling rig 202. As shown here, there may be a raising leg 252 movingly (such as slidingly) coupled with the main trough 229. The raising leg 252 may be powered by a raising leg piston 296. As the raising leg piston 296 is powered, a raising leg piston rod 296*a* may extend therefrom and raise the raising leg 252, which results in raising of the main trough 229.

Figure 2B:
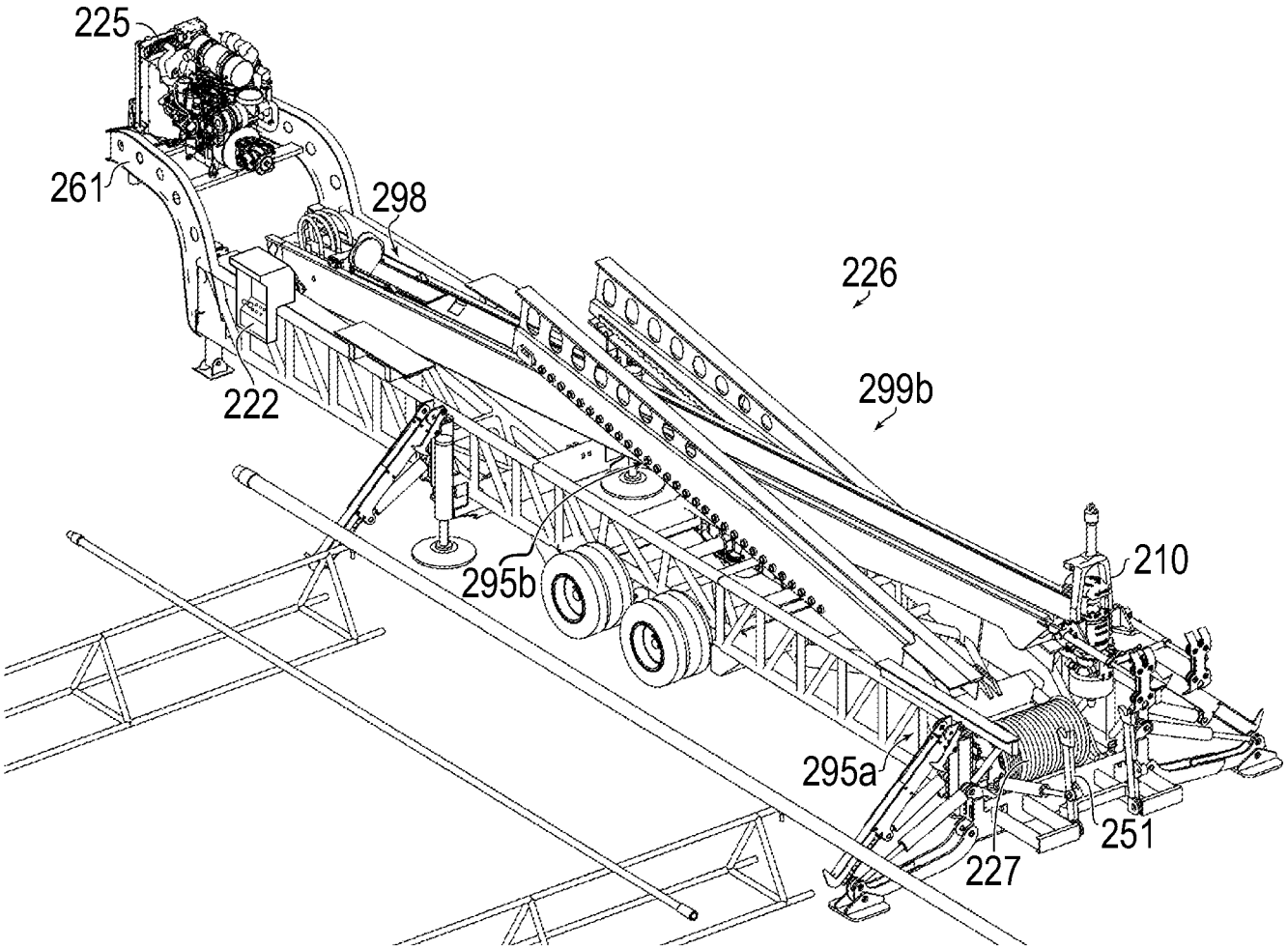
FIG. 2B shows an isometric front view of the combination handling unit of FIG. 2A in an intermediate position according to embodiments of the disclosure.
Figure 2C:
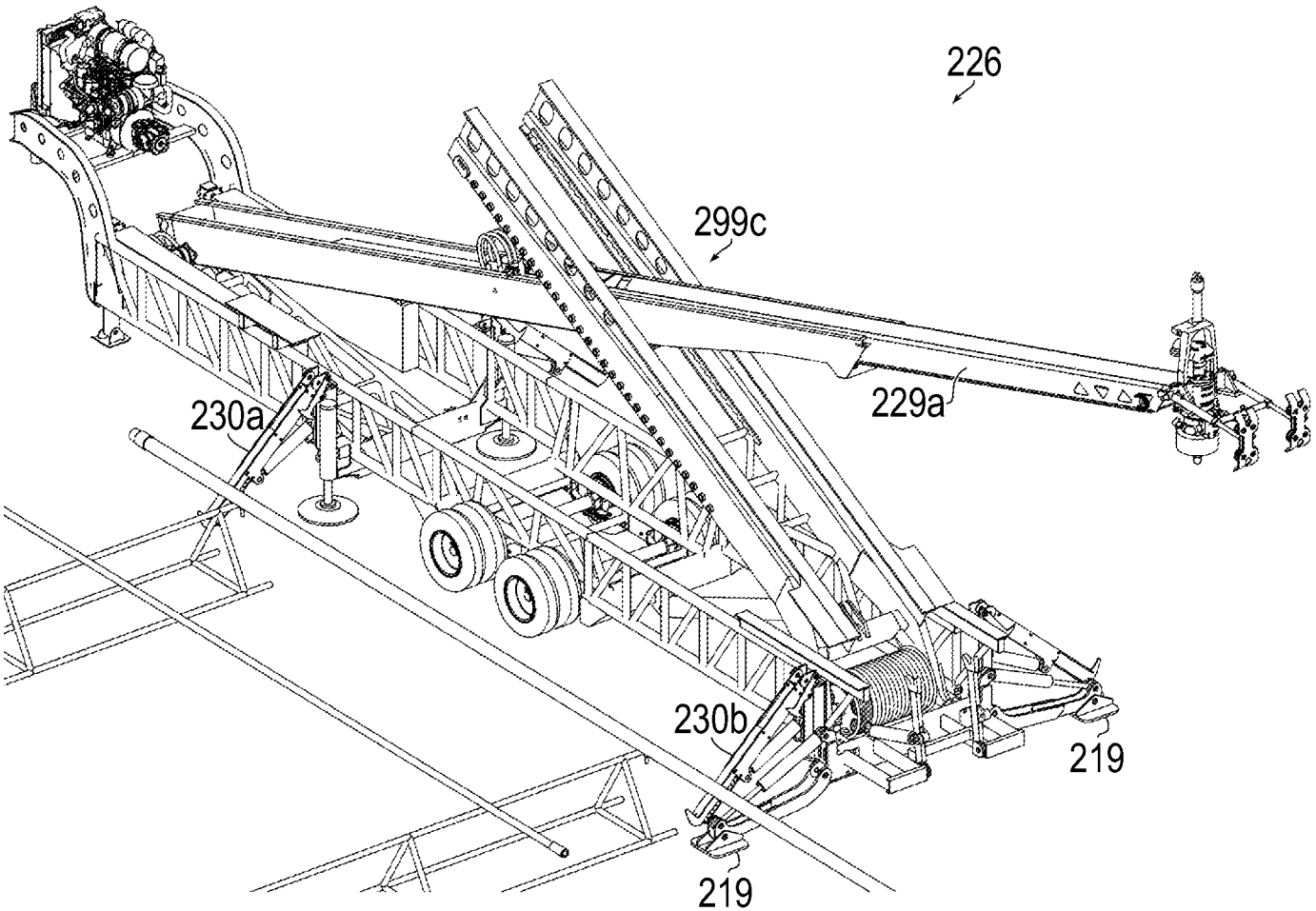
FIG. 2C shows an isometric front view of the combination handling unit of FIG. 2A having another intermediate position with an extended telescoping trough according to embodiments of the disclosure.
Figure 2D:
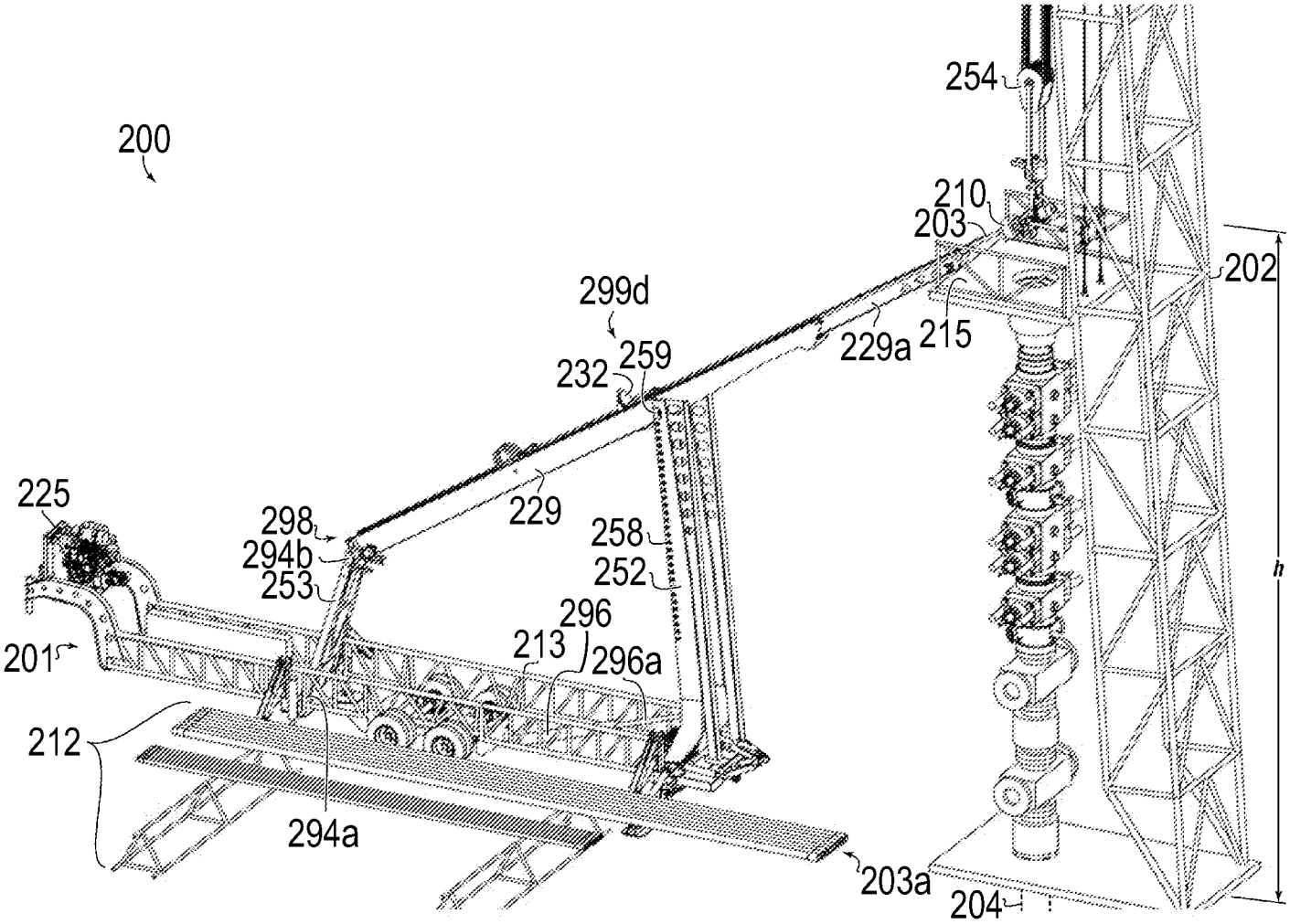
FIG. 2D shows an isometric front side view of the combination handling unit of FIG. 2A in a delivery position where a tubular and a power swivel are presented to a rig floor according to embodiments of the disclosure.

FIG. 2A shows the trough assembly 298 in a first or lowered position 299*a*, where the piston rod 296*a* is retracted; FIGS. 2B and 2C show the trough assembly 298 in a raised intermediate position(s) 299*b*, 299*c*; FIG. 2D shows the trough assembly 298 in a delivery position 299*d*. It would be appreciated that the delivery position 299*d* need not include the trough 229 moved to its highest position and/or the secondary trough 229*a* extended therefrom. Thus, the delivery position 299*d* may be tantamount to that of any intermediate position of the trough/trough assembly 229/298.

The raising leg 252 may be movingly (e.g., pivotably) coupled with the support frame 213, such as seen at first leg connection point 295*a*. The raising leg 252 may be movingly (e.g., slidingly) coupled with the main trough 229, such as seen at second leg connection point 295*b*. A plurality of connection points are possible, whereby the raising leg 252 may be coupled with the frame support 213 at two or more points and/or may be coupled with the trough 229 at two or more points.

Figure 4A:
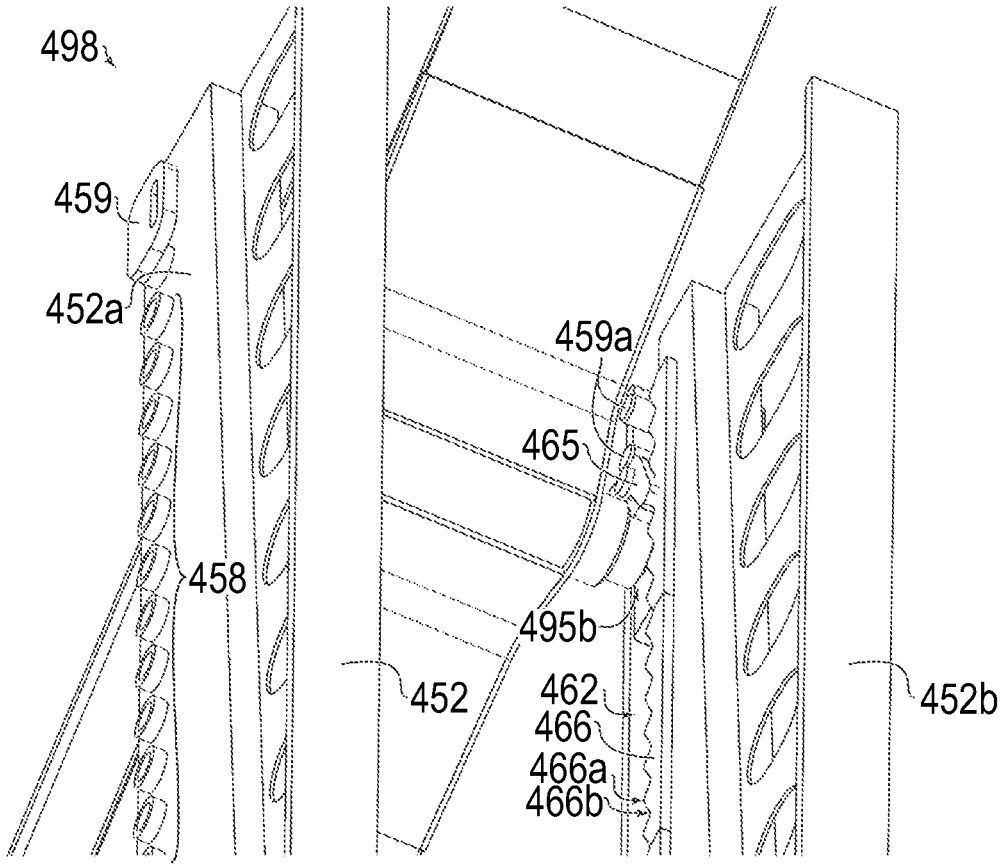
FIG. 4A shows an underside view of a trough assembly coupled with a raising leg according to embodiments of the disclosure.
Figure 4B:
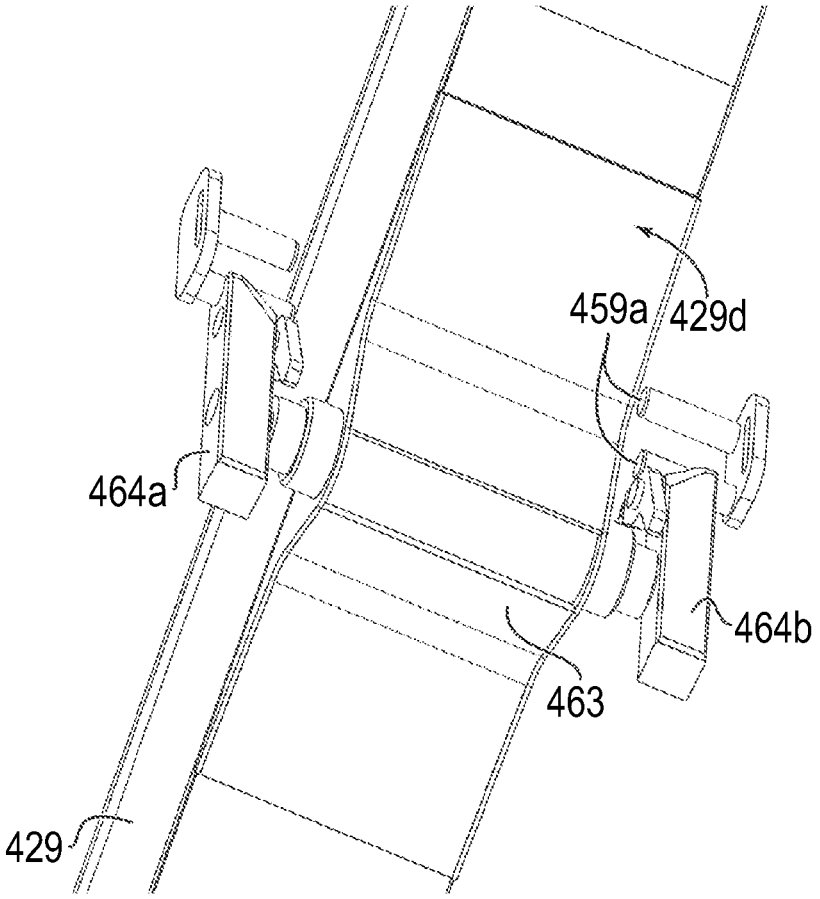
FIG. 4B shows an underside view of the trough assembly of FIG. 4A according to embodiments of the disclosure.

Referring briefly to FIGS. 4A and 4B together, an underside view of a trough assembly coupled with a raising leg, and an underside view of the trough assembly, in accordance with embodiments herein, are shown.

FIGS. 4A and 4B show the trough assembly 498 may have a portion thereof coupled with a raising leg 452. As shown in the figures, an underside 429*d* of the main trough 429 may have a trough housing 463. From the trough housing 463, there may be an at least one bullet slider 464*a* (or just 'slider') extending therefrom. In embodiments, there may be a first slider 464*a* and a second slider 464*b*. While not limited to any particular shape, the sliders 464 *a,b* may be configured to slidingly engage within a guide rail(s) 462 of the raising leg 452.

As shown, the raising leg 452 may slidingly engage with the trough assembly 498 on a first leg side 452*a* and a second leg side 452*b*.

Each of the sides 452 *a,b* may be configured with respective guide rails 462. The guide rail 462 may be configured with a ratchet structure 466, which may include alternating crest 466*a* and trough 466*b* structure. A locking dog 465 may be configured to navigate or move through the ratchet 466 in a first direction over each adjacent crest/trough, but is locked from moving in the opposite direction. It follows that the raising leg 452 and trough assembly 498 may slidingly move with respect to each other in the first direction, but may not in the opposite direction (unless and until the locking dog 465 is released/moved).

The locking dog 465 may be or include an assembly having have a spring-loaded (Rod-side) hydraulic cylinder that with pressure, which may be suitable to overcome a spring force and release the dog from engagement with the ratchet structure 466.

For example, extension of a cylinder by hydraulic pressure may release the dog 465. As such, loss of pressure may allow a rod-side spring to retract a cylinder and engage the latch on any crest/trough of the ratchet 466 (not shown here).

In embodiments dog 465 (or assembly) may include a dog-latch upper extension in contact with the selector pin 459, which by initial contact force may engage the dog 465 just before the slider(s) contacted the pin 459.

Any of the raising leg sides 452 *a,b* may also be configured with a set or row of selector pin holes 458. An end 459*a* of a selector pin(s) 459 may be pushed or otherwise disposed through the pin holes 458. The end 459*a* be of suitable shape, length, etc. to be a mechanical stop to the respective slider 464 *a,b* (see partial view of FIG. 4B) at connection point 495*b*.

Returning again to FIGS. 2A-2E, once the sliders (264 *a,b*, FIG. 4B) hit a selector pin 259 (disposed within an least one hole of a row of selector holes 258), the raising leg 252 may continue to lift the main trough 229, as well as a following leg 253. While not meant to be limited, the raising leg 252 may have a raising leg range of motion in a range of about 0 degrees (generally FIG. 2A) to about 130 degrees (generally FIG. 2D) with respect to a horizontal axis 255*b*. The raising leg 252 may be moved to a raising leg angle in a suitable manner whereby the trough assembly 298 may reach the rig floor 215 at a height h. The height h may be in a height range of about 5 feet to about 150 feet.

The position of the selector pin 259 may be readily and easily changed to accommodate different elevation requirements. The position of the selector pin 259 may be changed while the tubular handler 226 is in the lowered or first position.

The tubular handler 226 may also or alternatively include a mechanism to lift the main trough 229 (or end 229*b*) in order to adjust an angle of presentation of the tubular 203. Thus, the angle of presentation may vary (compare elevation of end 229*b* in FIG. 2A to FIG. 2D).

Figure 2E:
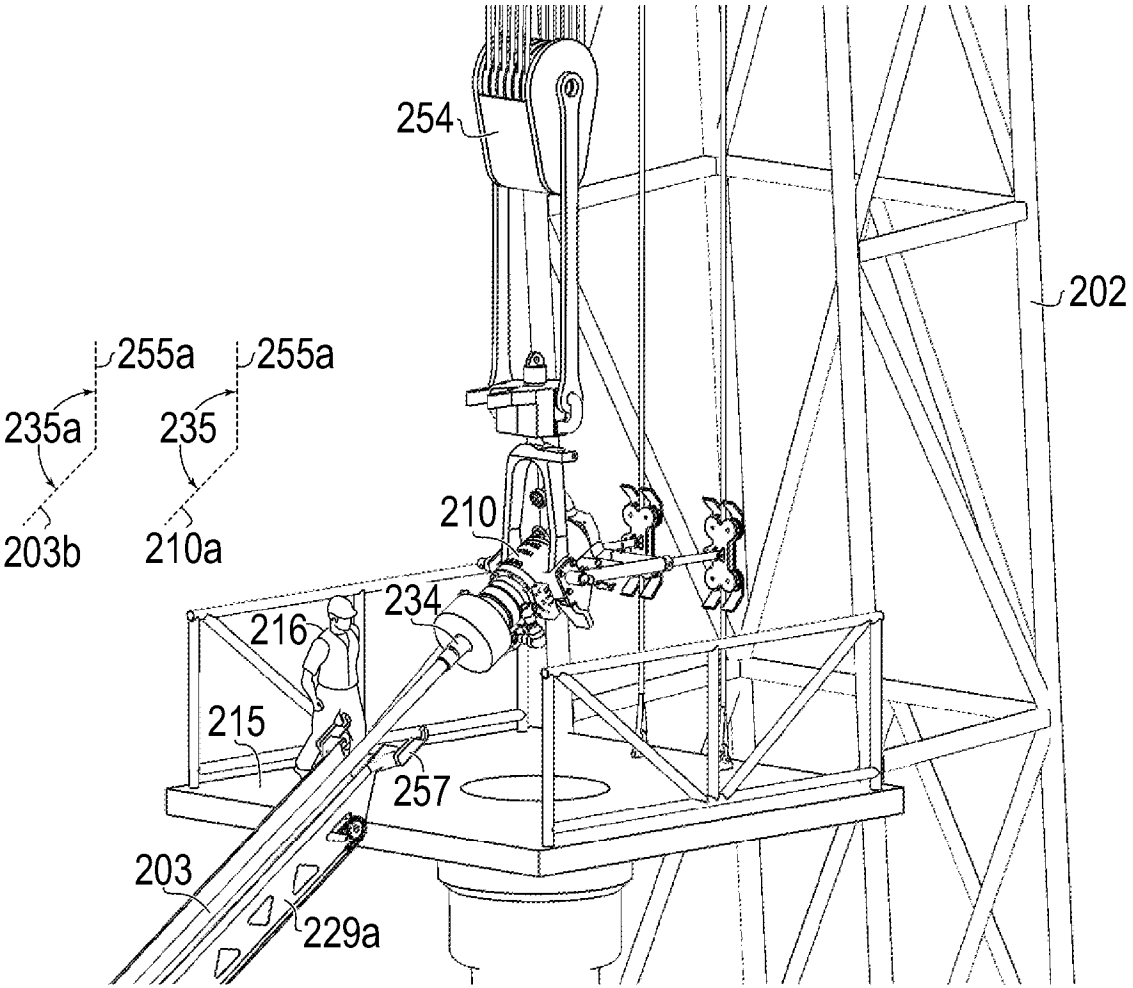
FIG. 2E shows an isometric view of the combination handling and transport unit of FIG. 2A in a delivery position where a power swivel is engaged with a tubular on the unit according to embodiments of the disclosure.

An angle of presentation 235*a* of the tubular 203 may be substantially parallel to a tilt angle 235 of the driver 210. FIG. 2E illustrates the driver 210 coupled with a travelling block 254 (of a derrick 202) may have a driver axis 210*a*. As a driver stem 234 of the driver 210 may be tilted, the driver stem 234 may be presented at the driver tilt angle 235 (such as with reference to a vertical axis 255*a*) for mating with a tubular 203.

In a similar manner, the tubular 203 may have a (longitudinal) axis 203*b*. The tubular may be presented (delivered) via the trough assembly 229 to personnel 216 on a rig floor 215 of the derrick 202. The tubular 203 may be presented with the angle of presentation of the tubular 235*a*. While it need not be exact, the driver tilt angle 235 and the angle of presentation 235*a* may be (substantially) parallel.

The following leg 253 may have movingly (e.g., pivotably) coupled with the support frame 213, such as seen at first following leg connection point 294*a*. The following leg 253 may be movingly (e.g., pivotably) coupled with the trough 229, such as seen at second following leg connection point 294*b*. A plurality of connection points are possible, whereby the following leg 253 may be coupled with the frame support 213 at two or more points and/or may be coupled with the trough 229 at two or more points (such as on each side of the following leg 253).

While not meant to be limited, the following leg 253 may have a following leg range of motion in a range of about 0 degrees (generally FIG. 2A) to about 130 degrees (generally FIG. 2D) with respect to the horizontal axis 255*b*. The following leg 253 may be moved to a following leg angle in a suitable manner whereby the trough assembly 298 may reach the rig floor 215 at the height h, and also the desired presentation angle may be achieved.

Once delivered, the driver 210 may be operatively attached to a traveling block or other suitable component(s) 254 of the rig 202. The pusher or skate 232 may extend or otherwise move the tubular 203 and present it to the rig 502. The driver 510 may have a stem 234 for threadably engaging the tubular 203. The traveling block 254 of the rig 502 may then be raised to lift the tubular 203. When presented to the rig 202 (or rig floor 505), the tubular 203 may be engaged (e.g., threadingly) by the driver 210, lifted off the trough 529, and then moved to a vertical position for engagement (making up) with another tubular (not shown here).

Figure 5A:
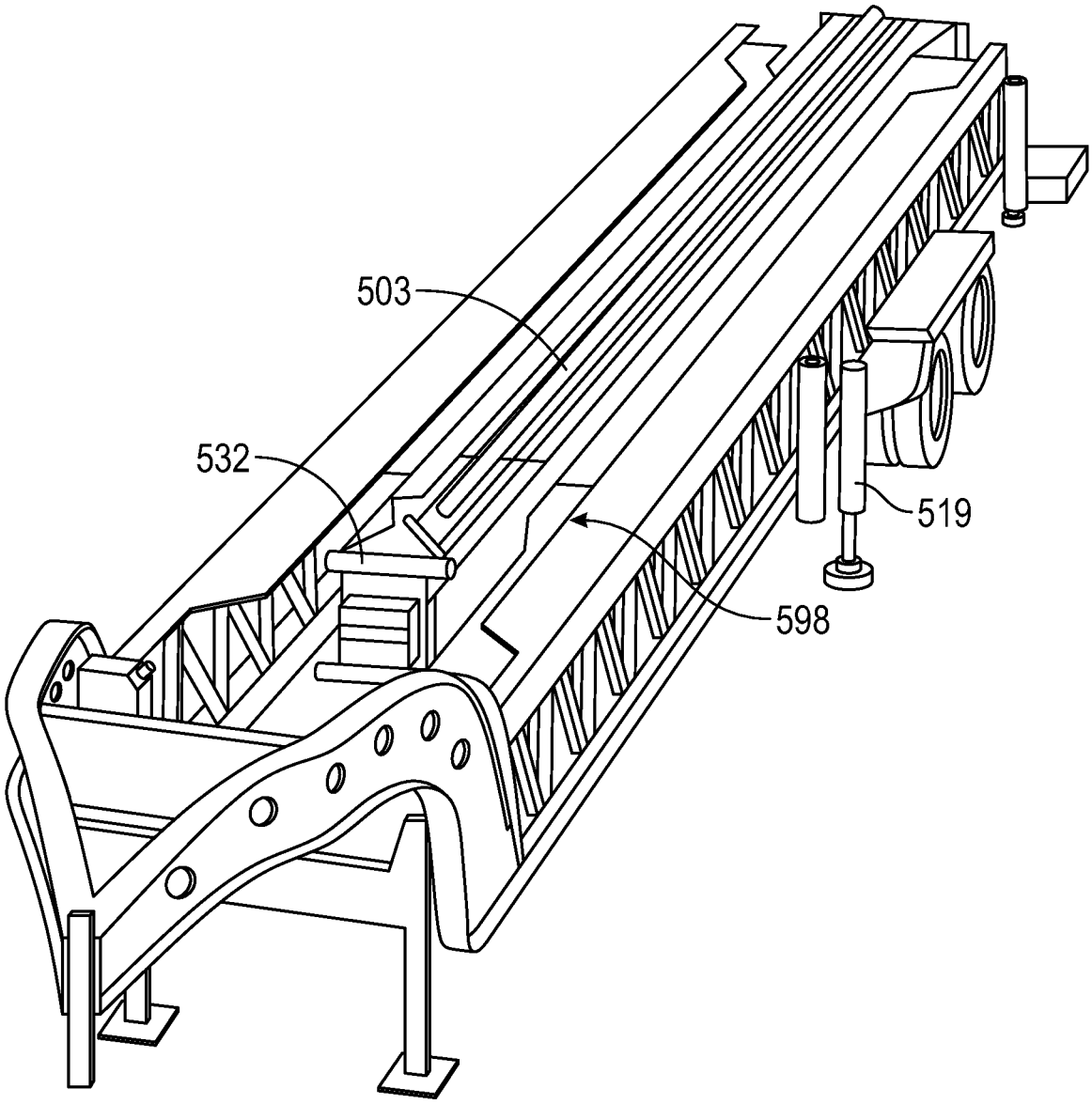
FIG. 5A shows an isometric view of a combination tubular and handling unit for use with a drilling operation or system, the unit in a first position, according to embodiments of the disclosure.
Figure 5B:
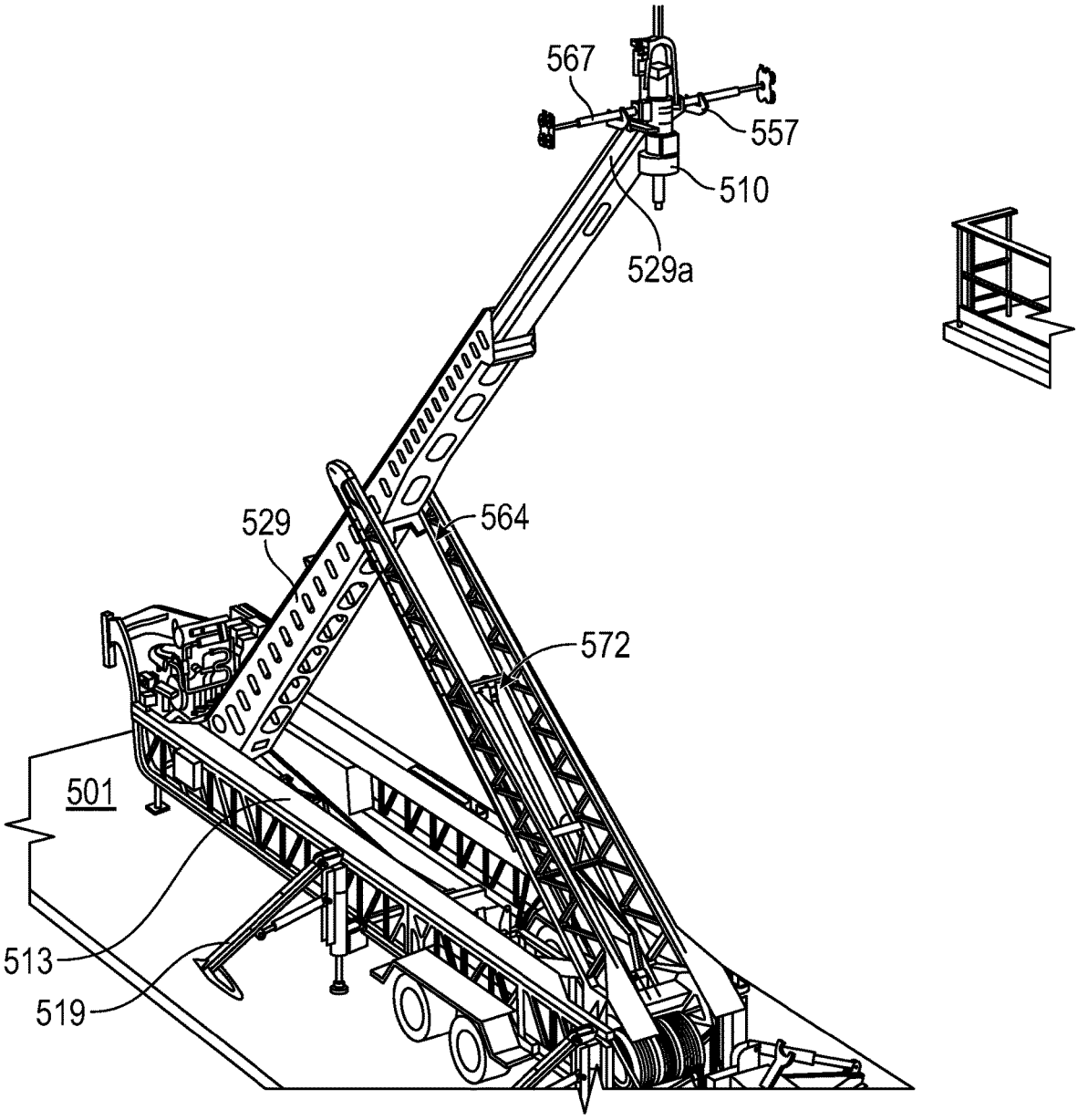
FIG. 5B shows an opposite side isometric view of the combination unit of FIG. 5A in an intermediate position according to embodiments of the disclosure.
Figure 5C:
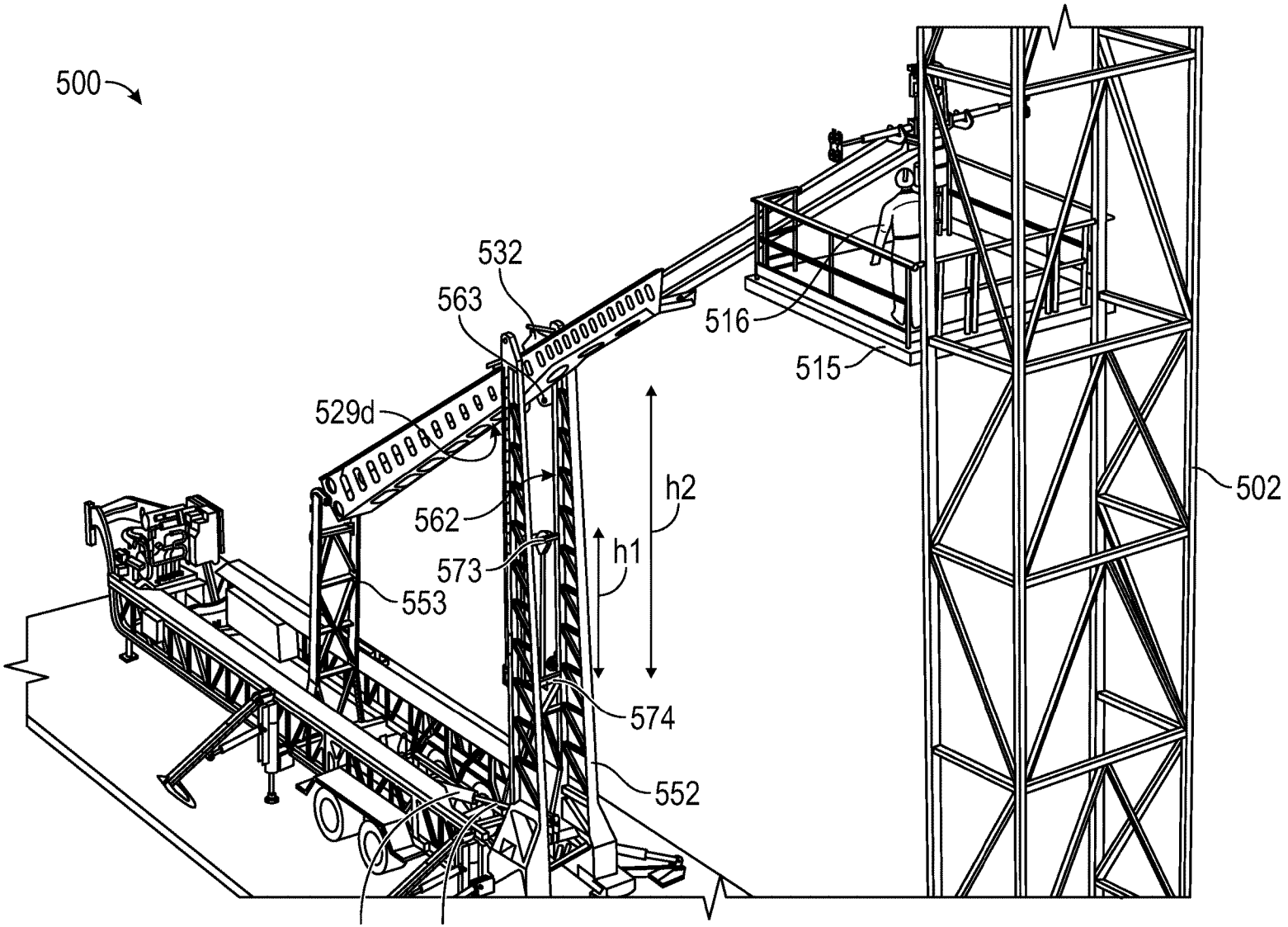
FIG. 5C shows an opposite side isometric view of the combination unit of FIG. 5A in a delivery position where a tubular and a power swivel are presented to a rig floor according to embodiments of the disclosure.

Referring now to FIGS. 5A, 5B, and 5C together, an isometric view of a combination tubular and handling unit for use with a drilling operation or system, the unit in a first position, an opposite side isometric view of the combination unit of FIG. 5A in an intermediate position, and an opposite side isometric view of the combination unit of FIG. 5A in a delivery position where a tubular and a power swivel are presented to a rig floor, illustrative of embodiments disclosed herein, are shown.

FIGS. 5A-5C show a drilling operation or system 500 having the combination tubular and power swivel handling unit 501. While referred to as 'drilling', the working operation or system 500 is not meant to be limited, as there are a number of instances and operations where the unit 500 (or one or more varied or alternate embodiments thereof) may be used. Some views are shown in part. For example, FIG. 5C shows a cutaway view of a rig or derrick 502, as a complete view is unnecessary for the understanding of embodiments herein (e.g., such that FIG. 5A does not show the rig). While referred to as a 'combination' unit, the unit 501 may be any type of powered unit that may need support for a load.

The combination unit 501 may include a reeving system 572 that pulls on a device associated with the unit 501 in order to support the load. The device may be pulled until it engages a stop or stopper, resulting in preload tension with a respective reeving cable. The reeving system may have one or more reeving cylinders operable (actuatable) via pressure held by a valve (load-holding valve and/or counterbalance valve). Although embodiments herein may refer to hydraulic actuation, other modes of actuation may be possible, such as electrical, mechanical, chemical, combinations thereof, and so forth.

The unit 501 may include a trough assembly engaged with a raising leg. Although not required, the unit 501 may also include a following leg. Either or both of the raising leg and the following leg may be pivotably coupled with a support frame of the unit 501 and/or the trough assembly.

The combination unit 501 may be operated or otherwise used in a manner to provide, control, facilitate, etc. handling and transport of one or more components. In embodiments, the unit 501 may provide delivery of either a tubular 503, a driver (e.g., power swivel) 510, both, or other equipment to the rig 502. While it need not be exactly the same, the unit 501 may be assembled, run, and operated as described herein (e.g., unit 201) and in other embodiments, and as otherwise understood to one of skill in the art.

Components of the unit 501 may be arranged by, disposed on, or otherwise coupled with a trailer or support frame 513, and as otherwise understood to one of skill in the art. Thus, the unit 501 may be comparable or identical in aspects, function, operation, components, etc. as that of other unit embodiments disclosed herein. Similarities may not be discussed for the sake of brevity.

Associated or auxiliary equipment including automation, controllers, piping, hosing, valves, wiring, nozzles, pumps, gearing, tanks, etc. may be shown only in part, or may not be shown or described, as one of skill in the art would have an understanding of coupling the components of the unit 501 for operation thereof. All components of the unit 501 requiring power or automation may be provided with wiring, tubing, piping, etc. in order to be operable therefore.

Although not limited to any particular type of equipment or load, FIGS. 5A-5C together show the reeving system 572 may be suitable for use with equipment associated with an oil and gas operation, such as the drilling operation or system 500.

As will be discussed, the reeving system 572 may be configured to add power to the motion of a bullet slider 564 through a raising leg rail 562 (of a raising leg 552) during raising of a trough assembly 598 from a first position (such as a ground or level position shown in FIG. 5A), to a second or intermediate position (FIG. 5B), and/or to a third or delivery position (FIG. 5C). This may be done in order to provide or facilitate relief to a raising leg piston/rod 596/596*a* from high forces and stresses.

Detrimental force and stress may result from exponential (or at least nonlinear) geometry governing the motion of the bullet slider 564 along the rail 562 when the raising leg 552 approaches a vertical (or near-perpendicular) position (especially in the event a following leg 553 remains seated).

The use of the reeving system 572 may be beneficial to avoid a rack and pinion system for use on the raising leg 552. In comparison, embodiments herein provide a fixed trough pivot, such that it may only be case to deal with the nonlinear motion of the slider 564. In summary, understanding of the geometry of the loading is highly beneficial.

To any extent embodiments herein are described for the transfer of tubulars and equipment to the derrick 502, one of skill would appreciate that as a job or operation is finished or otherwise at a stopping point, transfer of tubular(s) 503 and the driver 510 back to the ground may be achieved.

The unit 501 may be configured with one or more movable outriggers, extensions, jacks, legs etc. 519 coupled with the support 513, which may help secure or hold the unit 501 in a substantially immovable fashion.

The combination unit 501 may have the driver 510 movingly disposed thereon. That is, the driver 510 may be positioned within a support or rack. As the trough assembly 598 is raised by a raising leg 552, driver lifting hooks 557 may engage the support posts 567, and thus raise the driver 510 to the derrick 502.

One of skill would appreciate that all operations associated with operating the unit 501 (including operation of the trough assembly 598), as well as operation of the power swivel 510 (including while on the derrick 502), may be accomplished by personnel 516 via an operator station, without need for other operator stations. The station may be detachably secured to the support 513. Alternatively, a separate remote control panel placed on the rig floor for the rig operator's control of the driver 510.

The trough assembly 598 may include a main trough 529. The trough assembly 598 may have a portion thereof (such as an end 529*a*) configured for lifting the driver 510 off the rack. The trough assembly 598 may have a carrier trough 529*a* movingly engaged with the main trough 529. For example, the carrier trough 529*a* may be telescopingly movable with respect to the main trough 529, thereby providing additional length to which the trough assembly 529 may reach. In embodiments, the carrier trough 529*a* may extend between and including 0 feet and 50 feet out from the main trough 529; however, other lengths may be possible.

The trough assembly 598 may have a pusher or skate 532 operatively and movingly associated therewith. As such, the skate 532 may be operable to push the tubular 503 (or a portion of either troughs 529, 529*a*) in order to present the tubular 503 to the rig floor 515 (or the proximate area of the system 500 to which a tubestring may be made up). The skate 532 may be movable via a sprocket and chain mechanism, rollers, and so forth, which may be powered in a manner known to one of skill in the art.

The unit 501 may be configured with a mechanism or other suitable configuration to lift the trough assembly 598 (including an end of the trough 529*c*) to present or bring the tubular 503 to the drilling rig 502. As shown here, the raising leg 552 may be movingly (such as slidingly) coupled with the trough 529. The raising leg 552 may be powered by a raising leg piston 596. As the raising leg piston 596 is powered, a raising leg piston rod 596*a* may extend therefrom and raise the raising leg 552, which results in raising of the main trough 529.

FIG. 5A shows the trough assembly 598 in a first or lowered position, where the piston rod 596*a* is retracted; FIG. 5B shows the trough assembly 598 in a raised intermediate position(s); FIG. 5C shows the trough assembly 598 in a delivery position. It would be appreciated that the delivery position need not include the trough 529 moved to its highest position and/or the secondary trough 529*a* extended therefrom. Thus, the delivery position may be tantamount to that of any intermediate position of the trough/trough assembly 529/598.

The raising leg 552 may be movingly (e.g., pivotably) coupled with the support frame 513, such as at a first leg connection point. The raising leg 552 may be movingly (e.g., slidingly) coupled with the trough 529, such as at a second leg connection point. A plurality of connection points are possible, whereby the raising leg 552 may be coupled with the frame support 513 at two or more points and/or may be coupled with the trough 529 at two or more points.

As shown in the figures, an underside 529*d* of the main trough 529 may have a trough housing 563. From the trough housing 563, there may be an at least one bullet slider 564 (or just 'slider') extending therefrom. In embodiments, there may be a first slider and a second slider. While not limited to any particular shape, the slider 564 may be configured to slidingly engage within a guide rail(s) 562 of the raising leg 552. The sliders may be engaged with respective spindles disposed within the trough housing 563. The spindles (see 592 *a,b*; FIGS. 6B and 6D) may provide a freedom of movement between the raising leg(s) and the trough 529.

The activation of the reeving system 572 may be an automatic response to the movement of the raising leg 552. For example, there may be control logic associated with operation of the combination unit 501, whereby as the raising leg 552 begins to raise, each of the slider 564 (via trough housing 563 coupled with the main trough 529) and a sheave frame 573 begin to move.

Each of the slider 564 and the sheave frame 573 may move a certain length (or height 'h') from an initial position to a final position. The final position may be determined by placement of a stop or stopper for which the housing 563 (or respective sliders) may come into contact with (see, e.g., FIGS. 4A-4B). Regardless of stopper position, the difference in travel between the slider 564 (or housing 563) to that of the sheave frame 573 may be a ratio of about 2:1. The ratio may be determined by a number of sheaves used. Further description of the reeving system 572 will now be provided.

Figure 6A:
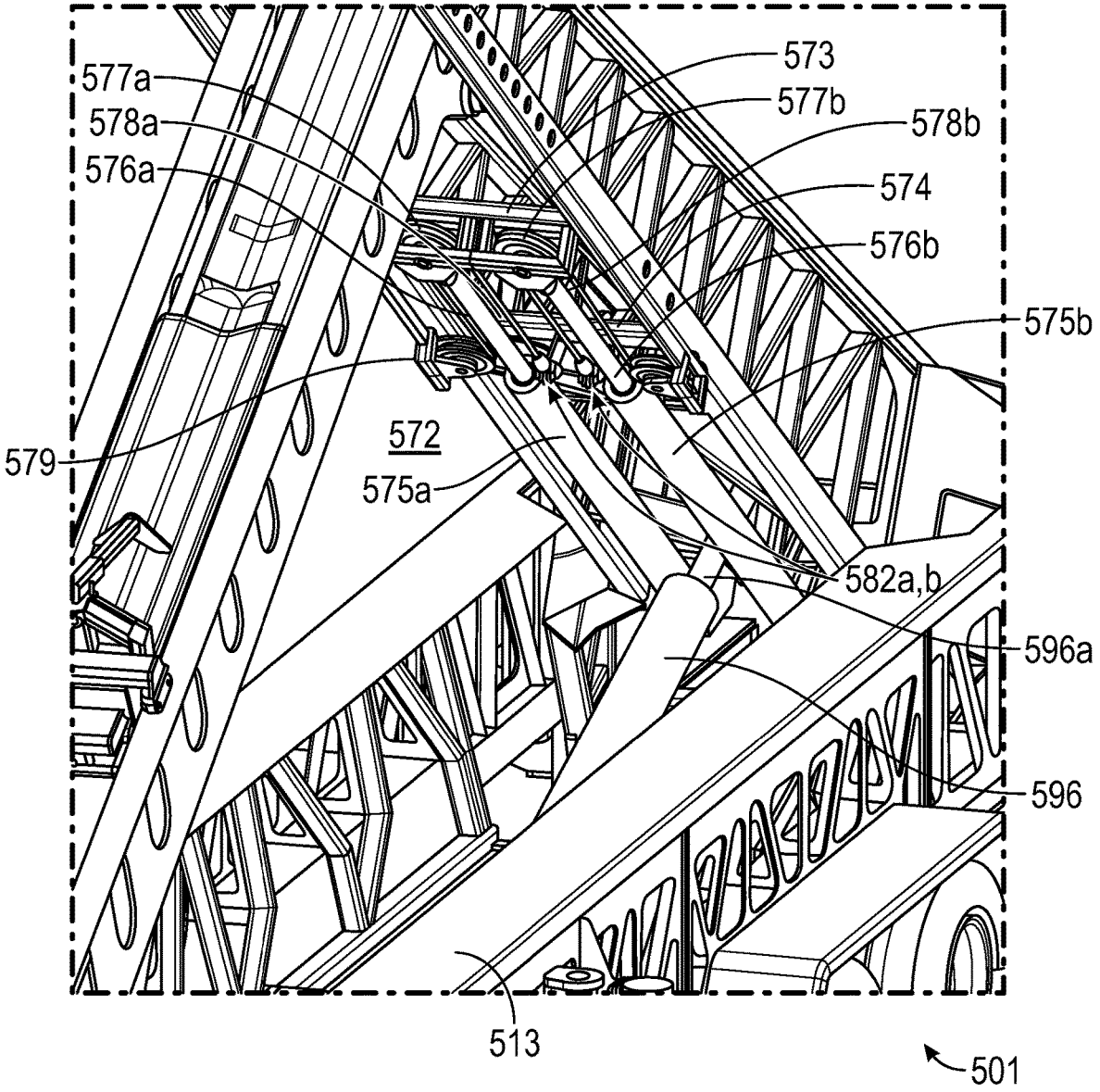
FIG. 6A shows an isometric partial view of a reeving system for use with a powered unit according to embodiments of the disclosure.
Figure 6B:
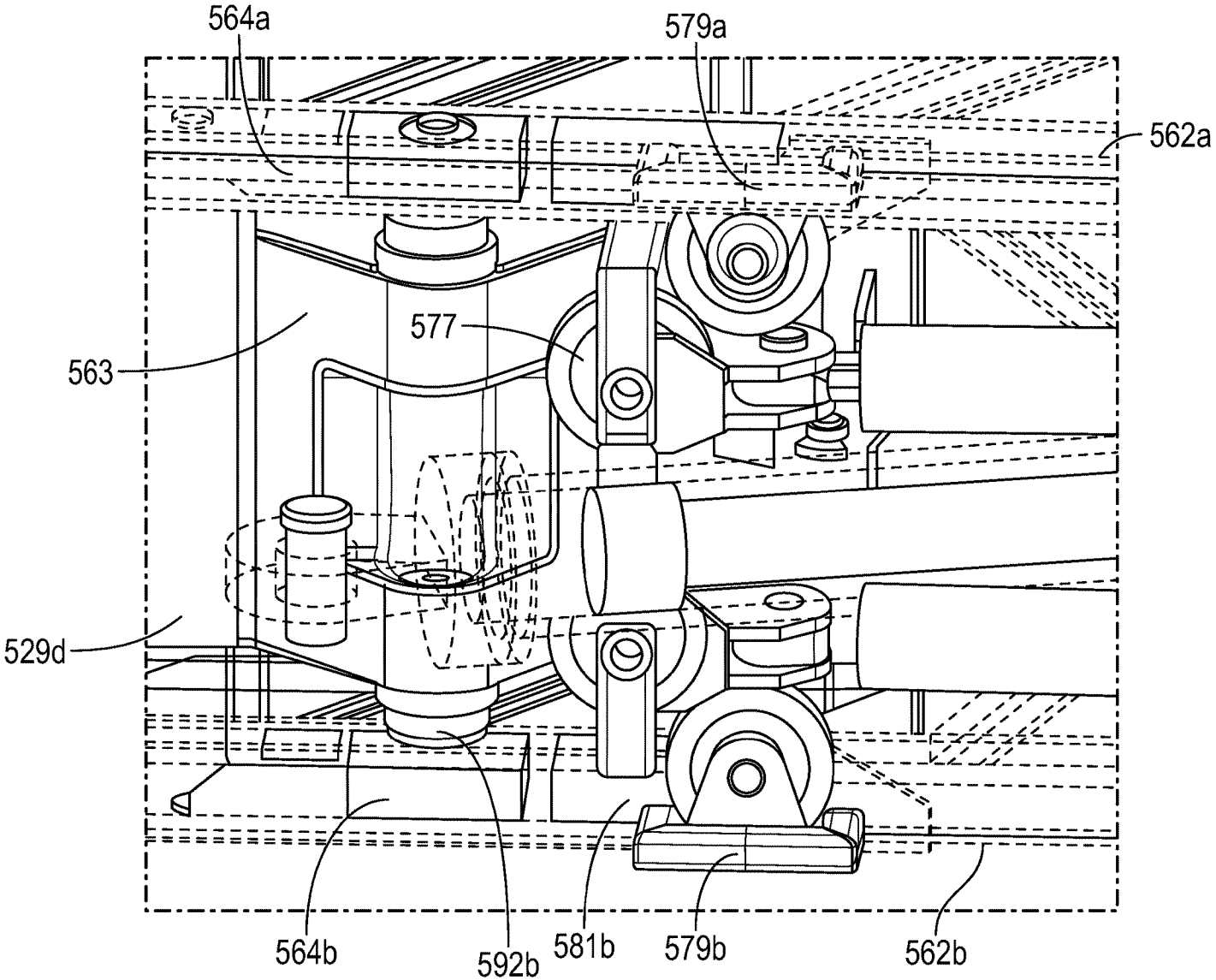
FIG. 6B shows an underside close-up view of the reeving system of FIG. 6A in a first position according to embodiments of the disclosure.
Figure 6C:
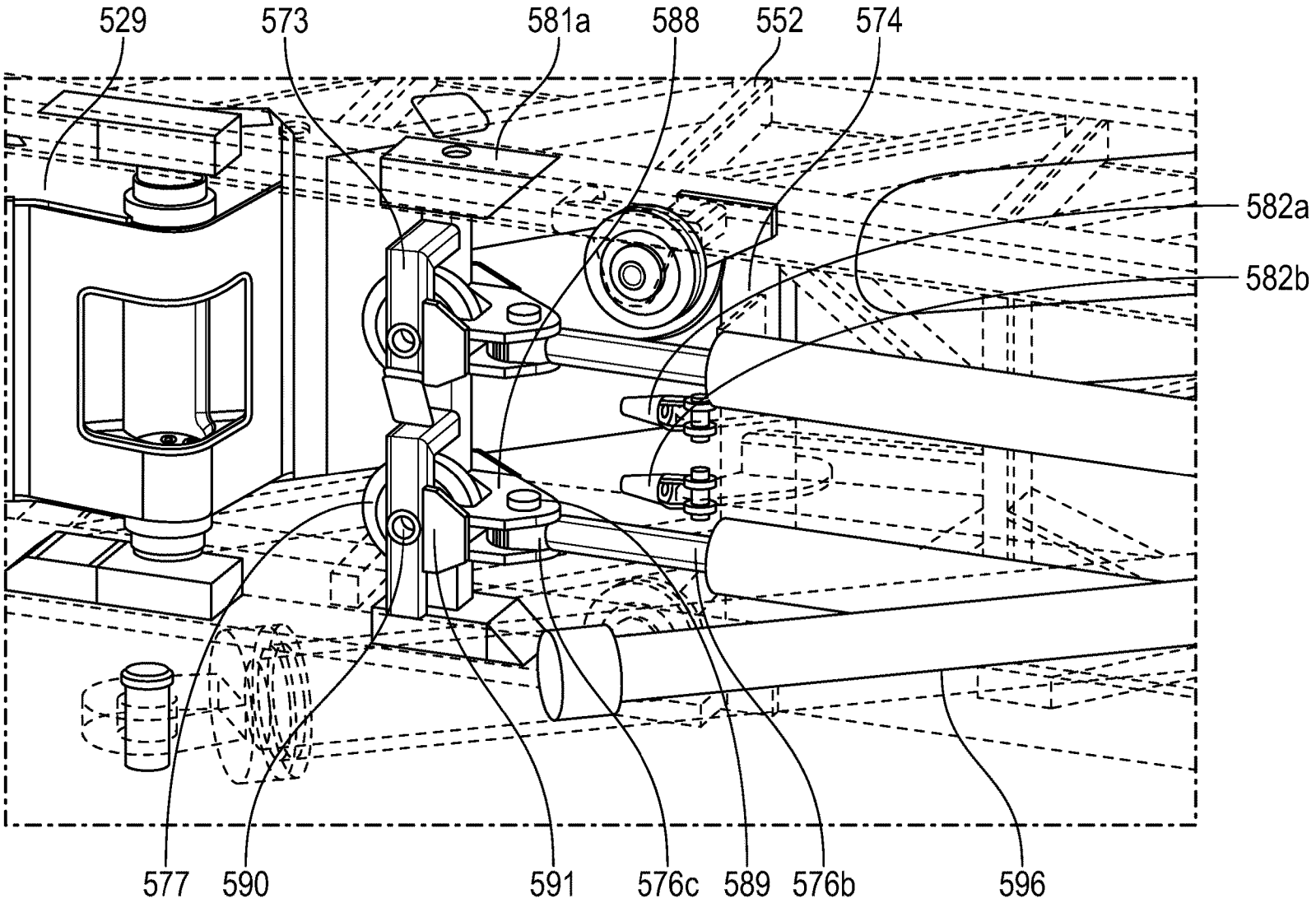
FIG. 6C shows an underside close-up view of the reeving system of FIG. 6A in a second or intermediate position according to embodiments of the disclosure.
Figure 6D:
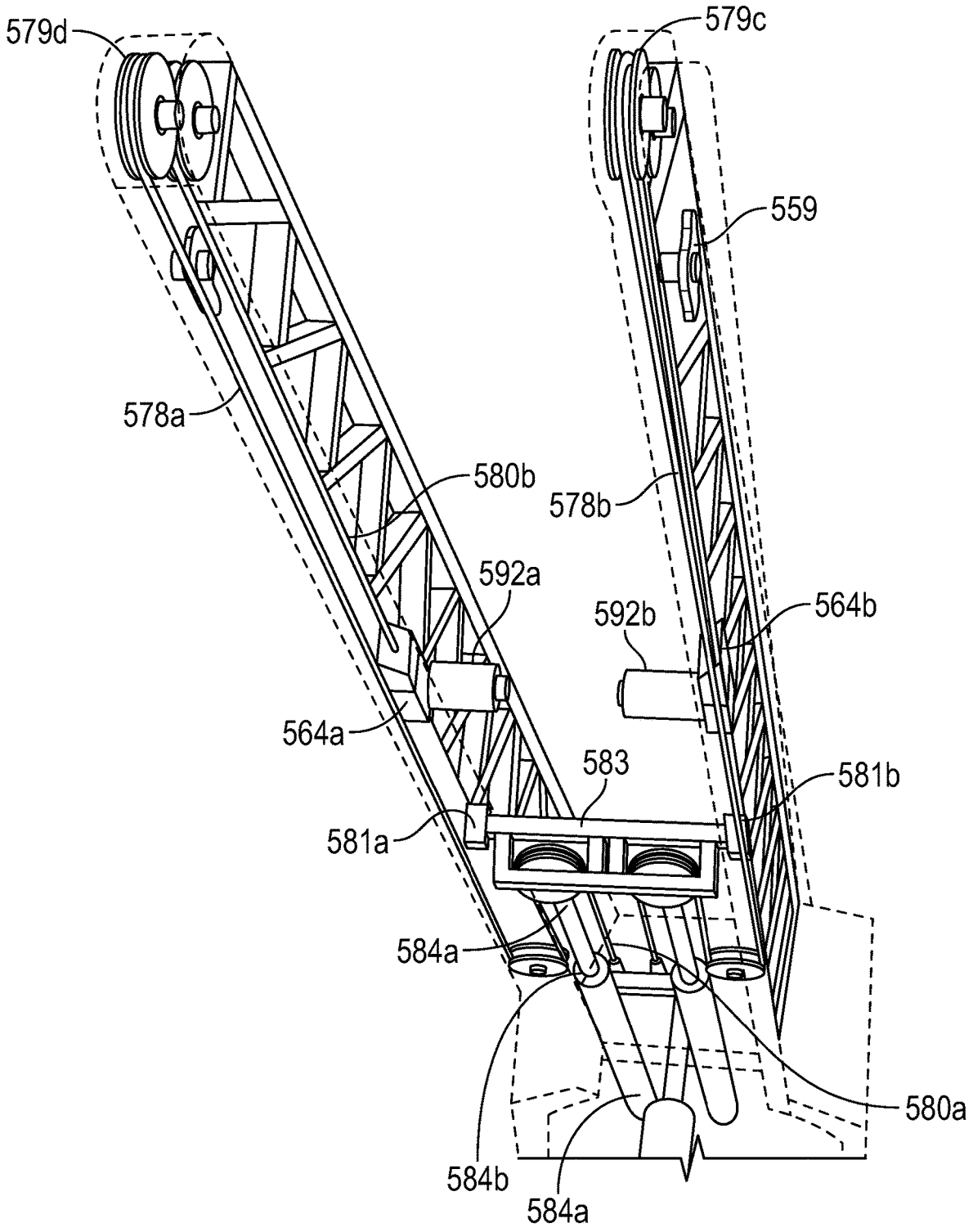
FIG. 6D shows a ghosted view of the reeving system engaged with a raising leg of a powered unit according to embodiments of the disclosure.

Referring now to FIGS. 6A, 6B, 6C, and 6D together, an isometric partial view of a reeving system for use with a powered unit, an underside close-up view of the reeving system of FIG. 6A in a first position, an underside close-up view of the reeving system of FIG. 6A in a second or intermediate, and a ghosted view of the reeving system engaged with a raising leg of a powered unit, illustrative of embodiments disclosed herein, are shown.

Powered unit 501 may be any type of machine, equipment, assembly, etc. that may be in need of supporting a load. The powered unit 501 may be like that of any combination unit described herein, or variants thereof. FIGS. 6A-6D show together a reeving system 572 that may be useable for support of the load. For example, powered unit 501 may experience a load upon the movement (raising/lowering) of a trough assembly 598 (or main trough 529). In order to move the trough assembly 598, a raising (piston) cylinder 596 may be actuated (e.g., pressurized), resulting in the extension of a raising piston rod 596*a*.

This motion results in a load on the unit 501. In a typical circumstance, the raising cylinder/rod 596/596*a* may be able to handle sufficient load necessary for the delivery of a tubular, equipment, etc. to a desired destination. However, in the event of a difficult load (such as by added weight or extended delivery height), the reeving system 572 may be used.

The reeving system 572 may include one or more reeving (barrel) cylinder/piston rods or just "cylinder" and "rods". For example, there may be a first reeving piston 575*a* and a second reeving piston 575*b* with a respective reeving piston rod 576 *a,b*. Either of the pistons 575 *a,b* may have a first end movably (e.g., pivotably or rotatably) coupled with a frame 513 of the unit 501 (not viewable here). In embodiments, the ends may be coupled with the raising leg 552. On the other end, either of the pistons 575 *a,b* may have its respective end slidingly extendable and retractable therefrom, whereby the (piston) rods 576 *a,b* may be coupled with respective sheave housings 591.

The sheave housing 591 may be a pseudo-y shape having a sheave or pulley 577 rotatably coupled therewith (such as via an axle). As shown here, the sheave housing 591 may have a stem 588 configured for movably coupling with a reeving piston rod end 576*c*. The sheave housing 591 may be coupled with or part of a sheave spreader or frame 573.

There may be additional sheaves or pulleys 577 disposed elsewhere. For example, there may be lower sheave mounts 579 *a,b*, and upper sheave mounts 579 *c,d*, each with a respective sheave 577 movably coupled therewith. Thus, while the sheave 577 may be free to rotate, the sheave mounts 579 *a-d* may be fixedly coupled (stationary) with the frame 513.

There may be a cable wrapped around the sheaves. For example, there may be a first cable 578*a* associated with the first sheave assembly, and a second cable 578*b* associated with the second sheave assembly. The cable (e.g., 578*a*) may have a first end 580*a* coupled at a first cable mount point 582*a*, and a second end 580*b* coupled at a second cable mount point, which may be a respective slider 564*b*. The mount points 582 *a,b* may be anchor points disposed on or otherwise associated with the raising leg 552.

As the reeving piston rods 576 *a,b* move the sheave frame 573, the frame 573 navigates (traverses) the cables 578 *a,b* therewith, resulting in a pull on the sliders 564 *a,b*. The sliders 564 *a,b* may be movably engaged with respective guide rails 562 *a,b* of the raising leg 552.

The reeving system 572 may include the first reeving piston (cylinder) 575*a* having a first piston end 584 *a* coupled with the support frame 513 or the raising leg 552. The piston 575*a* may have a second cylinder end 584*b* with the first reeving piston rod 576*a* movingly disposed therein.

The sheave spreader 573 may be movable. The spreader 573 may be engaged with the first reeving piston rod 576*a*, and having a first spreader sheave, the movable sheave spreader 573 also movably engaged with the raising leg 552.

The reeving system 572 may include a first set of sheave mounts 579 fixedly coupled with the raising leg 552, each mount comprising a respective mount sheave 572. There may also be a sheave base 574 coupled with the raising leg 552 (or the sheave base 574 may be part of the raising leg 552). The sheave base 574 may have one or more anchor points 582 for coupling with the cable. For example, there may be a first anchor point 582*a* and a second anchor point 582*b*. There may be a first cable 578*a* having a first cable end 580*a* coupled with the first anchor 582*a*. The first cable 578*a* may have a second cable end 580*b* coupled with a device associated with the load. The device shown herein may be a first slider 564*a*, and the load may be that of the main trough 529 (and its weight) moved or supported by the raising leg 552. The first cable 578*a* may also be engaged (such as wrapped at least partially around) with the first spreader sheave 577 and each respective sheave of the first set of sheave mounts.

The reeving system 572 may similarly include one or more redundant or repetitive components. For example, there may be a second reeving piston (cylinder) 575*b* having a first respective cylinder end coupled with the support frame 513 or the raising leg 552. There may be a second respective cylinder end having a second reeving piston rod 576*b* movingly disposed therein.

The reeving system 572 may include a second set of sheave mounts 579 fixedly coupled with the raising leg 552, each mount 579 comprising a respective second mount sheave 577.

The movable sheave spreader 573 may be engaged with the second reeving piston rod 576*b*. The spreader 573 may have a second spreader sheave 577. There may be a second cable 578*b* having a respective first cable end coupled with the second anchor point 582*b*. The second cable 578*b* may have a respective second end coupled with a second slider 564*b*. The second cable 578*b* may be engaged with the second spreader sheave 577 and each respective pulley 577 of the second set of pulley mounts 579.

The movable sheave spreader 573 may include a horizontal member 583 with a first frame slider or end 581*a* and a second frame slider or end 581*b*. The frame sliders 581 *a,b* may be movingly engaged with the raising leg 552, such as with the respective guide rails 562 *a,b*.

There may be a first sheave housing 591 having the first spreader sheave 577 coupled therewith. There may be a first sheave housing stem 588 coupled with the first reeving piston rod (such as with rod end 576*c*).

The movable sheave spreader 573 may include a second sheave housing 591*b* comprising the second spreader sheave 577*b* coupled therewith. The second sheave housing 591*b* may have a respective second sheave housing stem coupled with the second reeving piston rod.

FIGS. 6B and 6C illustrate by way of example the movable sheave spreader 573 may be configured to move from a first position (6B) to a second or intermediate position (6C). Movement of the sheave spreader 573 may result upon actuation of the first reeving piston 575*a* and/or the second reeving piston 575*b*. The sheave spreader 573 may return to the first position upon deactuation of the first reeving piston 575*a* and/or the second reeving piston 575*b*.

Actuation may refer to the powering of reeving system 572. Although not limited in any particular way, the power may result from pressurizing the cylinders 575 *a, b* with fluid (such as oil or hydraulic fluid). Operation of the reeving system 572 may controlled, such as via a controller and control logic.

Pressurization may result in the extension of the respective piston rods 576 *a,b* therefrom. Deactuation may entail relieving pressure from the respective cylinders 575 *a,b* to facilitate retraction of the respective piston rods 576 *a,b*.

The reeving system 572 may be configured to pull (move) the sliders 564 *a,b* until the sliders 564 *a,b* engages a stopper(s) 559 disposed within the raising leg 552. Although the sliders 564 *a,b* may come to a stop, the trough 529 may continue to move via support from the following leg 553.

The second position may refer to any intermediate position of the sheave spreader 573. In aspects, the second position may correspond with the sliders 564 *a,b* engaged with respective stoppers 559. In that regards, the distance traversed by the movable sheave spreader 573 from the first position to the second position may be approximately half the distance traversed by the sliders 564 *a,b* (as associated with trough housing 563 and slider mounts 592 *a,b*).

Advantages

Embodiments of a combination pipe handling and power swivel unit provide for a unique tubular handling unit that brings many benefits including safety, speed, and economic benefit.

This unit may be height adjustable without dangerous pinning, and may reach rig floors as high as forty feet without an extension. For spin up, a power swivel may automatically move to a same preset angle as the tubular laying in handler. Spin up torque may be backed up by a soft hydraulic tubular backup device.

Alternatively, if power swivel rotation is not desired by customer, the pipe handler may provide pipe rotation onto the pin of the non-rotating power swivel.

The unit may safely move the power swivel (or other tools, devices, components, etc.) to and from a rig floor, without the need for winching. The unit may move a control panel and control umbilical to personnel on the rig floor. Therefore, the need for climbing stairs and man-carrying a panel is mitigated or eliminated. When the power swivel is not in use, it may move to an out of the way park position.

Embodiments herein may reduce liability up to 50% by eliminating the need for additional personnel, as only one driver, truck, trailer, etc. need be used instead of two. And height adjustment required for various rig floor heights requires no dangerous pinning.

Other advantages herein may include less initial cost than separated, conventional pipe handler and power swivel units. Synergistically there may be less operating cost than two separate units (e.g., savings from labor, fuel, insurance, etc.), as well as less maintenance and storage cost than two separate units (only one trailer, engine, hydraulic system, etc.), space saving (only one footprint at rig site), and reduced environmental impact (one unit, one hydraulic system, one engine, etc.

Still other advantages include time savings, range of pipe length without extensions (tubular length capacity to 48'—no extension required), handling upwards of 2000 lb joints of pipe up to 5½" casing without adjustment, and flexible usage (service companies may offer either/both power swivel or tubular handling services with one unit).

Even a small savings in drilling or servicing time of individual wells results in an enormous savings on an annual basis.

While preferred embodiments of the disclosure have been shown and described, modifications thereof may be made by one skilled in the art without departing from the spirit and teachings of the disclosure. The embodiments described herein are exemplary only and are not intended to be limiting. Many variations and modifications of the embodiments disclosed herein are possible and are within the scope of the disclosure. Where numerical ranges or limitations are expressly stated, such express ranges or limitations should be understood to include iterative ranges or limitations of like magnitude falling within the expressly stated ranges or limitations. The use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, and the like.

Accordingly, the scope of protection is not limited by the description set out above but is only limited by the claims which follow, that scope including all equivalents of the subject matter of the claims. Each and every claim is incorporated into the specification as an embodiment of the present disclosure. Thus, the claims are a further description and are an addition to the preferred embodiments of the present disclosure. The inclusion or discussion of a reference is not an admission that it is prior art to the present disclosure, especially any reference that may have a publication date after the priority date of this application. The disclosures of all patents, patent applications, and publications cited herein are hereby incorporated by reference, to the extent they provide background knowledge; or exemplary, procedural or other details supplementary to those set forth herein.

What is claimed is:

1. A powered unit comprising:
- a support frame;
- a tubular handler coupled with the support frame, and comprising:
  - a trough assembly comprising:
    - a main trough having an underside configured with a trough housing; and
    - a first slider extending from the trough housing;
  - a raising leg movingly coupled with the main trough via a first guide rail having the first slider engaged therewith; and
- a reeving system comprising:
  - a first cylinder having a first rod movingly disposed therein;
  - a movable sheave spreader engaged with the first rod, and having a first spreader sheave, the movable sheave spreader further comprising:
    - a first sheave housing comprising the first spreader sheave coupled therewith;
  - a first set of sheave mounts coupled with the raising leg, each mount comprising a respective mount sheave; and
  - a first cable having a first cable end coupled with raising leg, and a second end coupled with the first slider.

2. The powered unit of claim 1, the powered unit further comprising:
- a transport mechanism configured to facilitate transfer of an at least one tubular to the trough assembly, wherein the trough housing has a second side configured with a second slider extending therefrom, wherein the raising leg is configured with a second guide rail, and wherein the second slider movingly engages with the second guide rail.

3. The powered unit of claim 2, wherein the reeving system further comprises:
- a second cylinder having a second rod movingly disposed therein; and
- a second set of sheave mounts coupled with the raising leg, each mount comprising a respective second set mount sheave, wherein the movable sheave spreader is engaged with the second rod, and having a second spreader sheave, wherein a second cable having a respective first cable end coupled with the raising leg, and a respective second end coupled with the second slider.

4. The powered unit of claim 3, wherein the movable sheave spreader further comprises a second sheave housing comprising the second spreader sheave coupled therewith, and a respective second sheave housing stem coupled with the second rod.

5. The powered unit of claim 1, wherein the movable sheave spreader further comprises a second sheave housing comprising a second spreader sheave coupled therewith.

6. The powered unit of claim 5, wherein the movable sheave spreader is configured to move from a first position to a second position upon actuation of the first cylinder, and return to the first position upon deactuation of the first cylinder.

7. The powered unit of claim 6, wherein the second position corresponds with the first slider engaged with a stopper disposed in the first guide rail, and also that the distance traversed by the movable sheave spreader from the first position to the second position is half the distance traversed by the first slider.

8. The powered unit of claim 7, the powered unit further comprising: a following leg pivotably coupled with the raising leg;

wherein the reeving system is configured to pull the first slider into engagement with the stopper, and wherein unless and until the second position is reached, the following leg does not move.

9. The powered unit of claim 7, wherein the first guide rail is configured with a ratchet structure that comprises an alternating crest and trough structure, and wherein a locking dog is configured to navigate or move through the ratchet structure in a first direction over each adjacent crest/trough.

10. A combination tubular handler and delivery unit comprising:

a support frame;

a tubular handler coupled with the support frame, and comprising:

a trough assembly comprising:

a main trough having an underside configured with a trough housing; and a first slider extending from the trough housing;

a raising leg movingly coupled with the main trough via a first guide rail having the first slider engaged therewith; and a reeving system comprising:

a first cylinder having a first rod movingly disposed therein;

a movable sheave spreader engaged with the first rod, and having a first spreader sheave, the movable sheave spreader also engaged with the first guide rail;

an at least one sheave mounts coupled with the raising leg, the at least one sheave mount comprising a respective mount sheave;

a first cable having a first cable end coupled with the raising leg, and a second end coupled with the first slider.

11. The combination unit of claim 10, the combination unit further comprising:

a transport mechanism configured to facilitate transfer of an at least one tubular to the trough assembly, wherein the trough housing has a second side configured with a second slider extending therefrom, wherein the raising leg is configured with a second guide rail, and wherein the second slider movingly engages with the second guide rail.

12. The combination unit of claim 11, wherein the reeving system further comprises:

a second cylinder having a second rod movingly disposed therein; and wherein the movable sheave spreader is engaged with the second rod, wherein a second cable having a respective first cable end coupled with the raising leg, and a respective second end coupled with the second slider.

13. The combination unit of claim 12, wherein the movable sheave spreader further comprises:

a horizontal member with a first frame end and a second frame end movingly engaged with the raising leg.

14. The combination unit of claim 13, wherein the movable sheave spreader further comprises a second sheave housing comprising a second spreader sheave coupled therewith.

15. The combination unit of claim 14, wherein the movable sheave spreader is configured to move from a first position to a second position upon actuation of the first cylinder and the second cylinder, and return to the first position upon deactuation of the first cylinder and the second cylinder.

16. The combination unit of claim 15, wherein the second position corresponds with the first slider and the second slider engaged with a respective stopper disposed in each of the first and second guide rails.

17. The combination unit of claim 16, wherein the combination unit further comprises a following leg pivotably coupled with the raising leg, wherein reeving system is configured to pull the first and second sliders until the sliders engage with the respective stoppers, and wherein unless and until the second position is reached, the following leg will not move.

18. The combination unit of claim 11, wherein the first guide rail is configured with a ratchet structure that comprises an alternating crest and trough structure, and wherein a locking dog is configured to navigate or move through the ratchet structure in a first direction over each adjacent crest/trough.

19. The combination unit of claim 18, the unit further comprising:

a hose reel comprising a plurality of hoses; and a pump disposed on the support frame.

* * * * *